US008074577B2

(12) United States Patent
Morichika et al.

(10) Patent No.: US 8,074,577 B2
(45) Date of Patent: Dec. 13, 2011

(54) STRUCTURE OF BIFURVATION AND CROSSOVER SITE OF GUIDEWAY IN GUIDED VEHICLE TRANSPORTATION SYSTEM

(75) Inventors: Shunji Morichika, Hiroshima (JP); Katsuaki Morita, Hiroshima (JP); Masahiro Yamaguchi, Hiroshima (JP); Kosuke Katahira, Mihara (JP); Yasuhiro Nagamichi, Mihara (JP)

(73) Assignee: Mitsubishi Heavy Industries, Ltd. (JP)

( * ) Notice: Subject to any disclaimer, the term of this patent is extended or adjusted under 35 U.S.C. 154(b) by 272 days.

(21) Appl. No.: 12/300,280

(22) PCT Filed: Nov. 7, 2007

(86) PCT No.: PCT/JP2007/072053
§ 371 (c)(1),
(2), (4) Date: Feb. 2, 2009

(87) PCT Pub. No.: WO2008/056817
PCT Pub. Date: May 15, 2008

(65) Prior Publication Data

US 2011/0114742 A1 May 19, 2011

(30) Foreign Application Priority Data

Nov. 10, 2006 (JP) ..... 2006-306037

(51) Int. Cl.
*B61F 13/00* (2006.01)

(52) U.S. Cl. ..... 104/139; 104/130.09; 105/72.2; 105/215.1

(58) Field of Classification Search ..... 104/130.09, 104/139, 104, 145, 146, 141, 305, 243, 244.1; 105/72.2, 215.1
See application file for complete search history.

(56) References Cited

U.S. PATENT DOCUMENTS 6,364,215 B1 * 4/2002 Andre et al. ..... 238/122
(Continued)

FOREIGN PATENT DOCUMENTS

JP 48-41188 6/1973
(Continued)

OTHER PUBLICATIONS

Search Report and Written Opinion from corresponding Singapore Patent Application No. 200809111-8.

(Continued)

*Primary Examiner* — Joe Morano, IV
*Assistant Examiner* — Jason C Smith
(74) *Attorney, Agent, or Firm* — Kanesaka Berner & Partners, LLP

(57) ABSTRACT

Structure of a bifurcation site and crossover site of a guideway in a guided vehicle transportation system; in which the guideway consists of left and right roadbeds, a depression between the roadbeds, and a guard rail having a U-shaped groove laid down on the depression; and a fail-safe mechanism is constituted by the guard rail and guard wheels attached to the vehicle; is proposed. The vehicle is equipped with automatic steering mechanisms for steering front and rear wheels and guard wheels supported laterally rotatably by front and rear supporting arms which are supported laterally rotatably underside the vehicle. The guard wheels are received in the groove of the guard rail. A movable guard plate and driving means thereof are provided to switch connection of the groove of the guard rail at a bifurcation thereof, and a movable plate and driving means thereof are provided to be able to plug or cover each of openings of grooves of guard rails in a region where the guard rail crosses a roadbed so that the movable plate is moved to plug or cover the groove thereby preparing a flat surface level with the roadbed.

13 Claims, 24 Drawing Sheets

U.S. PATENT DOCUMENTS

| | | | | |
|---|---|---|---|---|
| 6,477,963 | B1 * | 11/2002 | Weule et al. | 104/243 |
| 6,520,303 | B1 * | 2/2003 | Malek et al. | 191/22 R |
| 7,644,664 | B2 * | 1/2010 | Nakao et al. | 104/243 |
| 2007/0089635 | A1 * | 4/2007 | Blanco Montejo | 104/139 |
| 2008/0083345 | A1 * | 4/2008 | Morita et al. | 104/106 |
| 2009/0259352 | A1 * | 10/2009 | Morichika et al. | 701/19 |
| 2009/0288575 | A1 * | 11/2009 | Morichika et al. | 104/139 |
| 2009/0301342 | A1 * | 12/2009 | Morichika et al. | 104/243 |
| 2011/0067595 | A1 * | 3/2011 | Bourgier et al. | 104/139 |

FOREIGN PATENT DOCUMENTS

| | | | |
|---|---|---|---|
| JP | 48-49702 | | 6/1973 |
| JP | 48-55511 | | 7/1973 |
| JP | 48-62705 | | 8/1973 |
| JP | 49-38310 | | 4/1974 |
| JP | 49-47361 | | 12/1974 |
| JP | 50-119107 | | 9/1975 |
| JP | 52-32807 | | 3/1977 |
| JP | 53020204 | | 2/1978 |
| JP | 53-136785 | | 10/1978 |
| JP | 1978-136785 | U | 10/1978 |
| JP | 53136785 | | 10/1978 |
| JP | 53-152312 | | 11/1978 |
| JP | 55-117356 | | 8/1980 |
| JP | 1980-117356 | U | 8/1980 |
| JP | 55117356 | U | 8/1980 |
| JP | 55-126601 | | 9/1980 |
| JP | 55-126601 | A | 9/1980 |
| JP | 55-129220 | | 9/1980 |
| JP | 56-2561 | | 1/1981 |
| JP | 56-2561 | B2 | 1/1981 |
| JP | 562561 | | 1/1981 |
| JP | 57-187401 | | 11/1982 |
| JP | 2002351544 | | 12/2002 |
| JP | 2006175962 | | 7/2006 |
| JP | 2006-205945 | A | 8/2006 |
| JP | 2006205944 | | 8/2006 |
| JP | 2006205945 | | 8/2006 |
| JP | 2006205946 | | 8/2006 |
| JP | 2006-306334 | A | 11/2006 |
| JP | 2006306334 | | 11/2006 |
| JP | 2006351544 | | 12/2006 |
| WO | WO00/53480 | | 9/2000 |

OTHER PUBLICATIONS

Microfilm of the Specification and Drawings Annexed to the Request of Japanese Utility Model Application No. 40477/1977 (Laid-Open No. 136785/1978); Daifuki Kiko Kabushiki Kaisha; Oct. 28, 1978; p. 11, Line 9 to p. 12, Line 1; Figs. 6 to 9.

Microfilm of the Specification and Drawings Annexed to the Request of Japanese Utility Model Application No. 18194/1978 (Laid-Open No. 117356/1980); Mitsubishi Heavy Industries, Ltd; Aug. 19, 1980; p. 5, Line 7 to p. 7, Lime 14; Fig. 3.

Office Action dated Mar. 24, 2011 from corresponding application No. JP 2006-306037.

* cited by examiner

A cross section taken along section line B-B

A cross section taken along section line C-C (a)

(b)

(a)

(b)

View of A-A

STRUCTURE OF BIFURVATION AND CROSSOVER SITE OF GUIDEWAY IN GUIDED VEHICLE TRANSPORTATION SYSTEM

CROSS-REFERENCE TO REALATED APPLICATIONS

The present application is based on International Application No. PCT/JP2007/072053, Filed on Nov. 7, 2007, which in turn corresponds to Japanese Application No. 2006-306037 filed on Nov. 10, 2006 and priority is hereby claimed under 35 U.S.C. §119 based on these applications. Each of these applications are hereby incorporated by reference in their entirety into the present application.

BACKGROUND OF THE INVENTION

1. Technical Field

The present invention relates to structure of bifurcation and crossover sites of a guideway in a guided vehicle transportation system in which a vehicle supported by traveling wheels such as rubber-tired wheels for example travels on a guideway, the vehicle being equipped with an automatic steering mechanism and a fail-safe mechanism for coping with a case malfunction has occurred in the automatic steering mechanism or strong external lateral force due to a gust of cross wind, etc. exerts on the vehicle.

2. Technical Background

In a new transit system, a vehicle which travels by rotating rubber-tired wheels is generally provided with guide wheels which are guided along a guide rail laid down on a guideway along the guideway so that the vehicle is steered to travels along the guideway, and the vehicle is usually steered mechanically.

The mechanical guide mechanism is superior in point of view of safety and reliability, however, structure of bogies to which the wheels and driving mechanism thereof are mounted becomes complicated inevitably, is increased in weight, and results in increased running costs. Further, it is necessary to lay down the guard rail having enough strength to support the guide wheels all along the guideway with high accuracy, which results in increased construction costs of the guideway.

In order to eliminate the problems mentioned above, a steering system not requiring a guide rail is proposed in Japanese Laid-Open Patent Application No. 2002-351544 (patent literature 1).

The steering system of a guided vehicle disclosed in the patent literature 1 is composed such that a plurality of on-ground devices which memorize and send out information necessary for the operation of the vehicle are laid down along the whole length of the track on which the vehicle travels, the control device installed on the vehicle emits signals based on the information sent out from the on-ground devices when the vehicle travels along the track, and the vehicle is steered by the steering device installed on the vehicle in accordance with the signals. With the steering system, a guide rail for steering the vehicle is not required, construction and maintenance costs can be reduced, and also vibration and noise are reduced.

The steering system of the patent literature 1 will be explained referring to FIGS. 28*a*, 28*b*, and FIG. 29. FIG. 28*a* is a schematic side elevation of a vehicle provided with the conventional steering system, FIG. 28*b* is a schematic front elevation of FIG. 28*a*, and FIG. 29 is a schematic plan view of the conventional steering system. Referring to FIGS. 28*a*, 28*b*, and FIG. 29, reference numeral 03 is a vehicle used in the new tramway transit system, the vehicle 03 is a vehicle used in a new transit system and travels along a track 01. The vehicle 03 is supported on front and rear bogies 04 which supported by rubber-tired wheels 05 attached thereto. The wheels are driven by drive motors 06 and steered by actuators 07.

The steering system includes on-ground devices 02, a transmitter 09, a receiver 09, a control device 010, and a steering device 020. The vehicle is steered by turning the wheels 05. A plurality of non-exited on-ground devices 02 are laid down on the track 01 along whole length thereof at a predetermined spacing. Specific information is memorized in each of the on-ground devices. The specific information includes the discrimination number, position information, track information, and control information of the concerned on-ground device.

Position information(geographic site information) is information concerning the position of each on-ground device 02 such as the absolute coordinate point and distance from a reference point. Further, track information expressing conditions of the track at the site of each on-ground device such as the gradient, curvature, cant, ramification of the track are memorized in each of the on-ground device as necessary(the information is collectively referred to as operation information hereafter).

Although each of the on-ground devices 02 is not exited, i.e. has not been provided with power sources, it emits signals of the information memorized upon receiving electric power. The on-ground device 02 has for example an electronic circuit including ROM for memorizing operation information.

The transmitter 08 is a device for feeding electric power by means of a radio wave. The receiver 09 is a device for receiving the operation information emitted from the on-ground device 02 when the device 02 has received the radio wave. The control device 010 is a device for performing prescribed processing based on the operation information the receiver 09 received and transmitting directive signal of speed and steering of the vehicle to the drive motor 06 and actuator 07.

The steering device 020 is a device for turning the wheel 05 under the steering directive and comprises an electric or hydraulic or pneumatic actuator 07 connected to an end of an arm 011 of which the other end is supported for rotation by a pin 012 fixed to the bogie 04, a connecting rod 059, levers 056*a* and 056*b* for left and right wheel 05 respectively, and a tie rod 057 for connecting the levers.

When the actuator 07 is actuated by the steering directive from the control device 010, the arm 011 is rotated about the pin 012 and the levers 056*a*, 056*b* are turned via the connecting rod 059 and the tie rod 057 to turn the wheels 05 to the right or left.

According to the automatic steering system, the vehicle 03 is steered based on the operation information memorized in the on-ground devices 02 without using a guide rail, etc. Therefore, construction cost of the track 01 is decreased to a large extent because the guide rail, etc. is not needed. Further, as wear-out parts such as guide wheels are not used, maintenance cost is decreased, and also occurrence of vibration and noise which will occur when the guide rail and guide wheels are provided due to the contact between them can be reduced.

However, according to the automatic steering system disclosed in the patent literature 1, mechanical steering by means of the guide rail and guide wheels is not performed, and a problem of securing safety of vehicle traveling against runaway and running out of track when malfunction occurs in the steering system and under abnormal circumstances caused by strong wind, rainfall, snowfall, etc. has not been solved.

The applicant of this patent application proposed such a fail-safe mechanism in Japanese Laid-Open Patent Application No. 2006-175962 (patent literature 2) that can secure safety when malfunction occurs in the steering system with simple and light-in-weight construction.

The fail-safe mechanism is composed such that a guard groove is formed along the guideway of a guard rail havin a groove is laid down on a guideway along the guideway, and the vehicle is provided with guard wheels under the front and rear bogies supporting the vehicle body so that the vehicle travels with the guard wheels received in the groove of the guard rail. An ample clearance is secured between the periphery of the guard wheel and both side walls of the groove of the guard rail, the clearance being smaller than permissible limit clearance so that running out of the guide wheels from the groove does not occur.

When the automatic steering system functions normally, the vehicle travels with the guard wheels not contacting the side walls of the groove, however, when malfunction occurs in the automatic steering system or external force exerts on the vehicle due to a gust of cross wind for example, the guard wheels contact the side wall of the groove and running out of the guide wheels from the groove is prevented.

However, in the guided vehicle transportation system provided with the fail-safe mechanism as mentioned above, there are inevitably bifurcation site or crossover site such as Y-shaped fork roads or X-shaped fork roads, where guard rail diverges into two or more guard rails.

As the width of the groove of the guard rail is larger than the diameter of the guard wheel so that a permissible clearance is secured between the periphery of the guard wheel and side walls of the groove, for example, when the diameter of the guard wheel is 150 mm, the width of the groove of the guard rail is determined to be about 250~300 mm. At apart where the guard rail crosses a roadbed on which the traveling wheels of the vehicle travel, the traveling wheels must cross over the opening of the groove of the guard rail. When the width of the opening of the groove of the guard rail is wide as mentioned above, tires of the traveling wheels may fall into the groove or be bitten into the opening of the groove when passing over the guide rail, suffer injury, and vibration occurs which deteriorate ride quality. Further, there is a possibility that the guard rail is damaged.

DISCLOSURE OF THE INVENTION

The present invention was made in light of the background as mentioned above, and the object of the invention is to secure smooth travel of the vehicle at a bifurcation or crossover site of the guideway by eliminating the problems mentioned above that occurs when the vehicle passes the portion where the guard rail crosses the roadbed and to secure smooth switching of connection of the groove of the guard rail to an intended groove of the guard rail at a branching part thereof in a guided vehicle transportation system in which a fail-safe mechanism is constituted by the automatic steering mechanisms provided to the vehicle, guard wheels supported underside the vehicle, and guard rail laid down on the guideway.

To attain the object, the present invention proposes structure of a bifurcation site and crossover site of a guideway in a guided vehicle transportation system in which a vehicle travels on a pre-established guideway; the guideway being consisted of left and right roadbeds on which left and right traveling wheels of the vehicle travel, a depression formed between the roadbeds, and a guard rail made of a channel-steel having a U-shaped groove laid down on the surface of the depression along the center line between the roadbeds so that the top of the guard rail is level with the surfaces of the roadbeds; the vehicle being provided with automatic steering systems for steering front wheels and rear wheels respectively by means of actuators each being provided for steering the front and rear wheels; the vehicle being provided with guard wheels in its underside rotatably in a lateral plane; the guard wheels being received in the groove of the guard rail with an ample clearance(clearances) between the periphery of the guard wheel and the side wall(walls) of the groove of the guard rail being laid down along the center line of the guideway; a fail-safe mechanism being constituted by the guard wheels and the guard rail; wherein a movable guard plate and driving means thereof are provided to switch connection of the groove of the guard rail at a branching part thereof, and groove width Wmin of each of the branching guard rails at a part thereof crossing a roadbed is narrow than groove width W in regions other than the crossing part and larger than guard wheel diameter G.

Specifically, groove width Wmin of each of the branching guard rails at a part thereof crossing a roadbed is determined to be narrow than groove width W in regions other than the crossing part and larger than guard wheel diameter G such that $W>Wmin>G+2c$, where $c\approx 1$ mm.

According to the first invention, connection of a groove of guard rail to a branched groove is done by means of the movable guard plate so that the guard wheels can transfer smoothly to an intended groove of guard rail at a branching part of the guard rail, and as the width of the opening of the groove of the guard rail is narrowed at the crossing part where the guard rail crosses the road bed so that $W>Wmin>G+2c$ as mentioned above, the traveling wheels can pass over the opening of the groove of the guard rail smoothly without the tires of the traveling wheels being bitten into the opening.

As long as malfunction does not occur in the automatic steering mechanisms or any external force exerts on the vehicle, the vehicle travels automatically steered and the guard wheels pass the bifurcation of the guard rail without contacting the side walls of the guard rail, the movable guard plate, and other devices at the bifurcation.

In the first invention, the crossing part where the guard rail crosses the roadbed is composed simply by narrowing the opening of the groove of the guard rail, the crossing part can be constructed compactly without wearing parts and at low cost, and also maintenance work thereof is easy.

The present invention proposes as a second invention structure of a bifurcation site and crossover site of a guideway in a guided vehicle transportation system in which a vehicle travels on a pre-established guideway; the guideway being consisted of left and right roadbeds on which left and right traveling wheels of the vehicle travel, a depression formed between the roadbeds, and a guard rail made of a channel-steel having a U-shaped groove laid down on the surface of the depression along the center line between the roadbeds so that the top of the guard rail is level with the surfaces of the roadbeds; the vehicle being provided with automatic steering systems for steering front wheels and rear wheels respectively by means of actuators each being provided for steering the front and rear wheels; the vehicle being provided with guard wheels in its underside rotatably in a lateral plane; the guard wheels being received in the groove of the guard rail with an ample clearance(clearances) between the periphery of the guard wheel and the side wall(walls) of the groove of the guard rail being laid down along the center line of the guide way; a fail-safe mechanism being constituted by the guard wheels and the guard rail; wherein a movable guard plate and driving means thereof are provided to switch connection of the groove of the guard rail at a bifurcation thereof, and a movable plate and driving means thereof are provided to be able to plug or cover each of openings of grooves of guard rails in a region where the guard rail crosses a roadbed so that the movable plate is moved to plug or cover the groove thereby preparing a flat surface level with the roadbed.

In the second invention, that the movable guard plate and driving means thereof are provided to switch connection of the groove of the guard rail at a bifurcation thereof is the same as the first invention. In the second invention, a movable plate and driving means thereof are provided to be able to be moved to plug or cover each of openings of grooves of guard rails in a region where the guard rail crosses a roadbed, thereby preparing a flat surface level with the roadbed, by which the traveling wheels of the vehicle can pass over the groove of the guard rail at the crossing part where the guard rail crosses the roadbed more smoothly as compared with the case of the first invention.

In the first and second inventions, by composing such that said movable guard plate is a guard plate laterally swingable about a pivot at an end thereof, whereby connection of the groove of the guard rail at the crossover site can be switched by swinging the guard plate by the drive means; or such that said movable guard plate is a right triangular prism-shaped guard member laterally slidable, whereby connection of the groove of the guard rail at the crossover site can be switched by sliding the guard plate by the driving means; switching of the groove of the guard rail can be performed by relatively compact construction.

In the second invention, by composing such that said movable plate is a plate provided in the groove of the guard rail so that the plate can be moved up until the upper surface thereof is level with the top of the guard rail and moved down to open the opening of the groove of the guard rail and further to secure a space for the guard wheels received in the groove to be able to proceed without interfering with the plate by means of the drive means, the opening of the groove of the guard rail can be closed and opened with the movable plate provided in the groove without using space outside the guard rail.

In the second invention, it is also suitable to compose such that said movable plate is a plate laterally slidable provided on the roadbed so that the upper surface thereof is level with the surface of the roadbed so that the plate can be slid by the drive means to cover the guard rail. With the composition, the opening of the groove of the guard rail can be closed or opened without using inside space of the groove of the guard rail, and drive means of the movable plate can be constructed compactly.

In the second invention, said movable guard plate and said movable plate are controlled in association with each other by a controller located in a ground station in accordance with position of the traveling vehicle on the guideway.

According to the first invention, a movable guard plate is provided at the bifurcation of the guard rail having a U-shaped groove in which guard wheels supported underside of the vehicle laterally rotatably are received so that connection of groove of the guardrail is switched by moving the movable guard plate by means of a drive device thereof, and the width of the groove of the guard rail is narrowed at a crossing part where the guard rail crosses the roadbed on which the traveling wheels of the vehicle travels, the vehicle can pass over the opening of the groove of the guard rail smoothly without the tires of the traveling wheel being bitten into the opening of the groove and without occurrence of vibration.

Further, the construction is compact, highly reliable, and easy in maintenance.

According to the second invention, a movable guard plate is provided at the bifurcation of the guard rail having a U-shaped groove in which guard wheels supported underside of the vehicle laterally rotatably are received so that connection of groove of the guard rail is switched by moving the movable guard plate by means of a drive device thereof, and a movable plate is provided to be able to be moved to plug or cover each of openings of grooves of guard rails in a region where the guard rail crosses a roadbed, thereby preparing a flat surface level with the roadbed, by which the traveling wheels of the vehicle can pass over the groove of the guard rail at the crossing part where the guard rail crosses the roadbed more smoothly as compared with the case of the first invention.

In the first and second invention, the vehicle can travel without the guard wheels of the vehicle contacting the side walls of the groove of the guard rail and devices provided at the bifurcation of the guard rail by automatic steering, so occurrence of troubles at the bifurcation can be reduced.

In the first and second invention, it is preferable that the guard rail is made of a channel steel having a U-shaped groove with flange parts formed at the top of each of the side walls of the groove to extend laterally toward the groove.

DETAILED DESCRIPTION OF THE INVENTION

Preferred embodiments of the present invention will now be detailed with reference to the accompanying drawings. It is intended, however, that unless particularly specified, dimensions, materials, relative positions and so forth of the constituent parts in the embodiments shall be interpreted as illustrative only not as limitative of the scope of the present invention.

Figure 1:
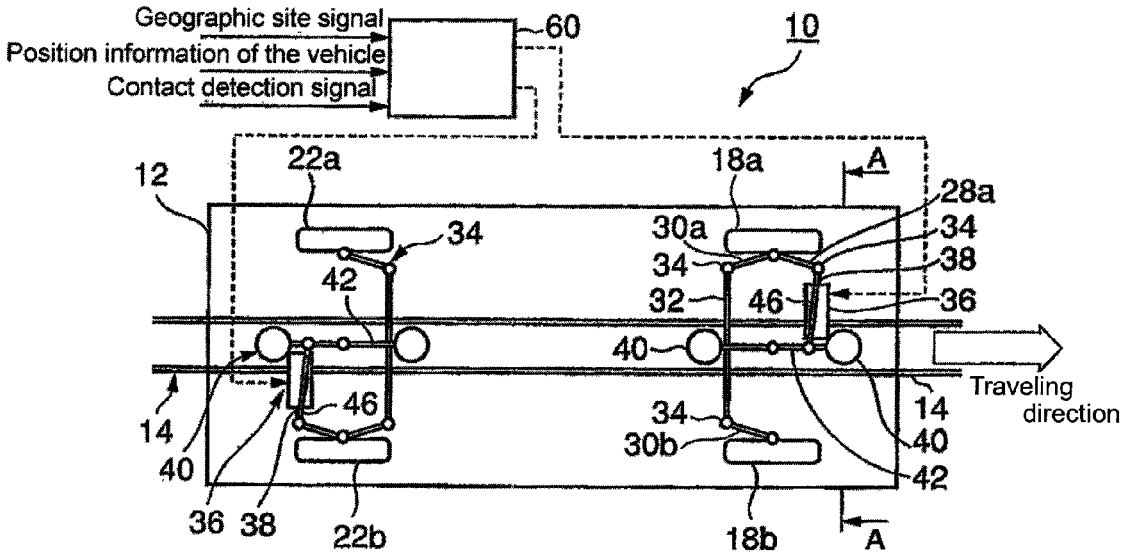
FIG. 1 is a schematic plan view of a guided vehicle transportation system.
Figure 2:
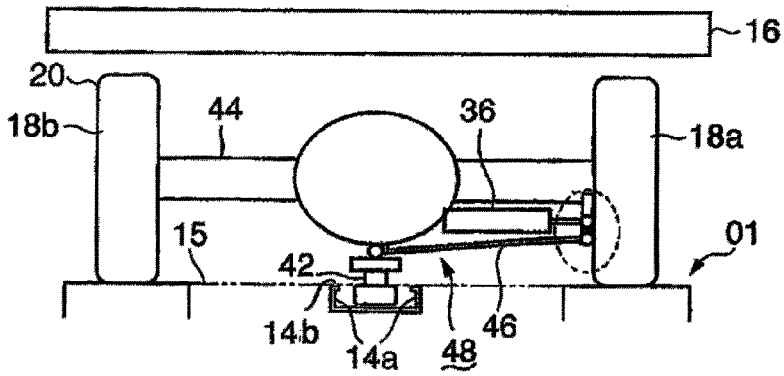
FIG. 2 is a cross section taken along section line A-A in FIG. 1.
Figure 3:
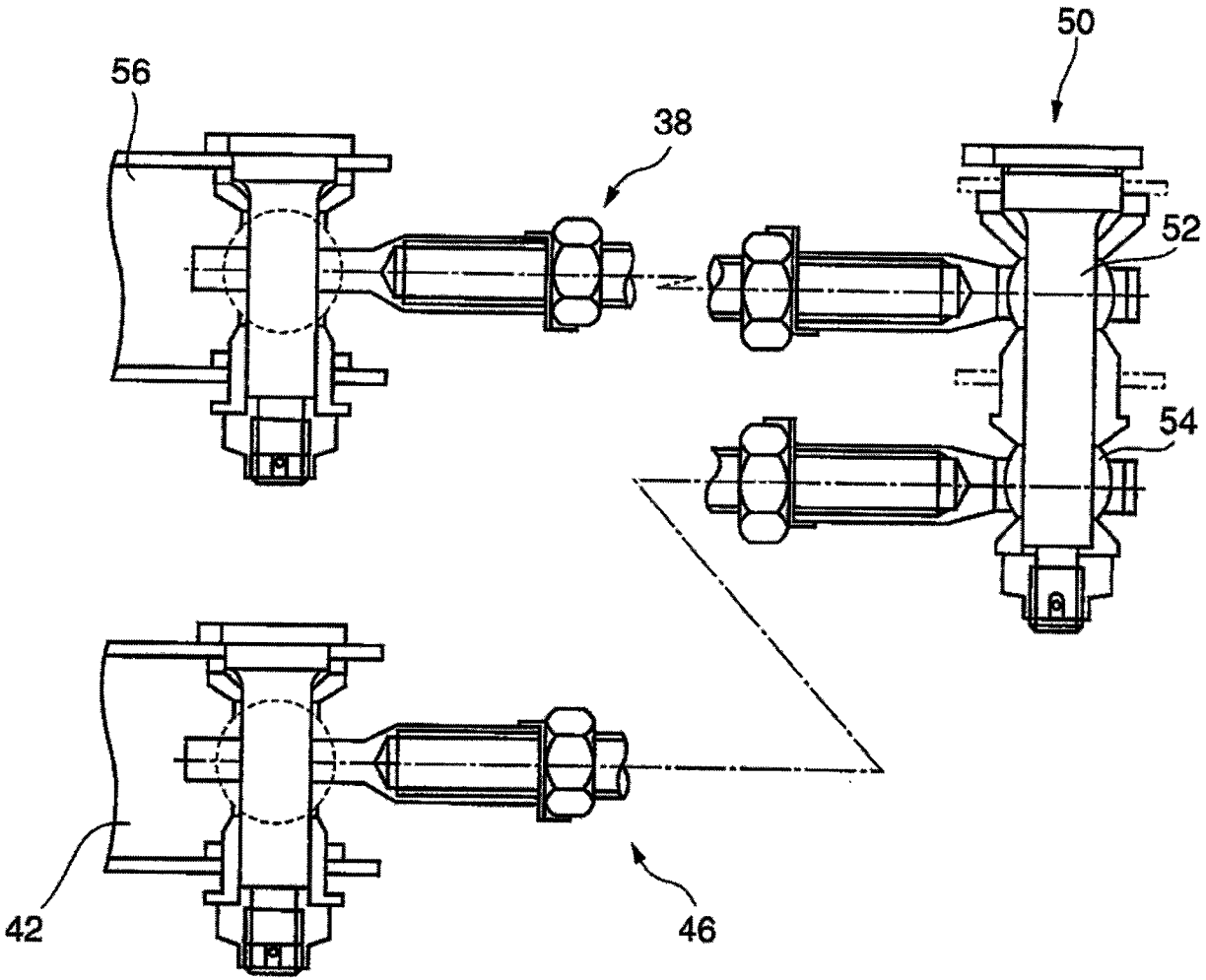
FIG. 3 is an enlarged view of a part encircled by circle B in FIG. 2.
Figure 4:
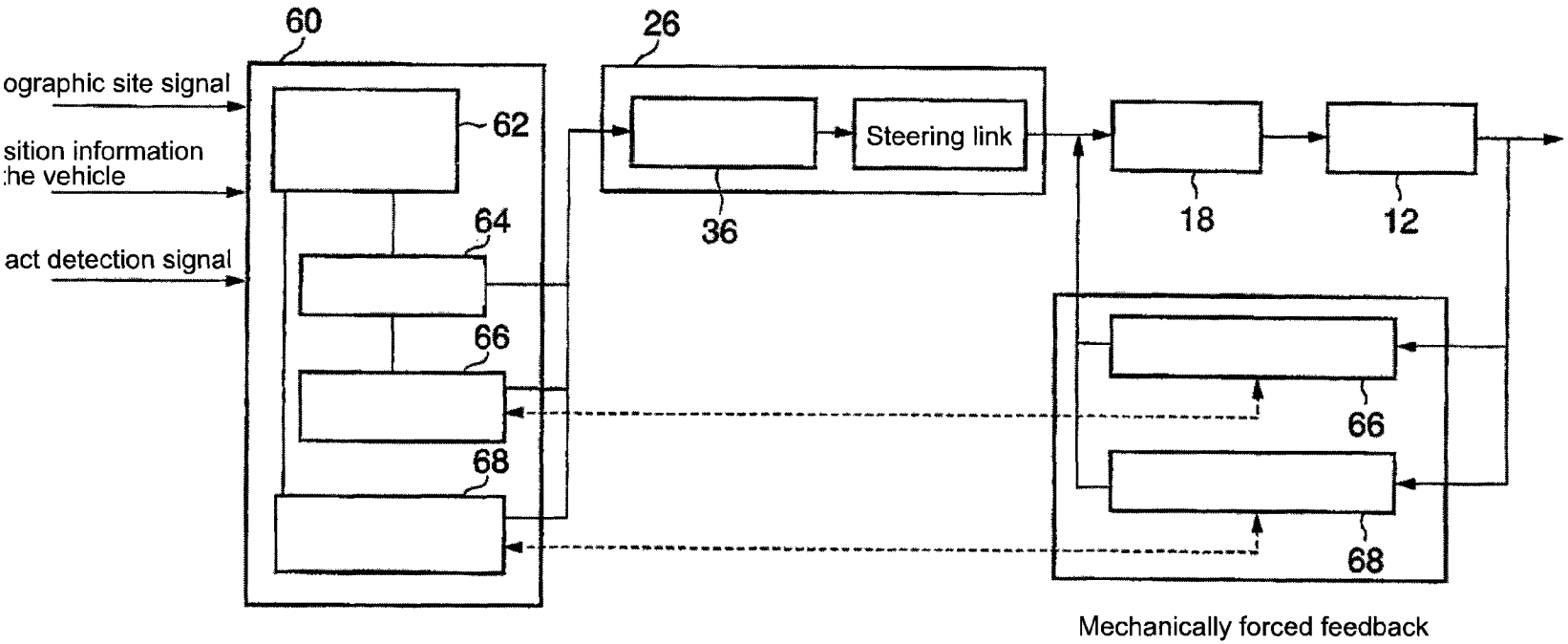
FIG. 4 is a control block diagram of the steering system of vehicle in the guided vehicle transportation system.
Figure 5:
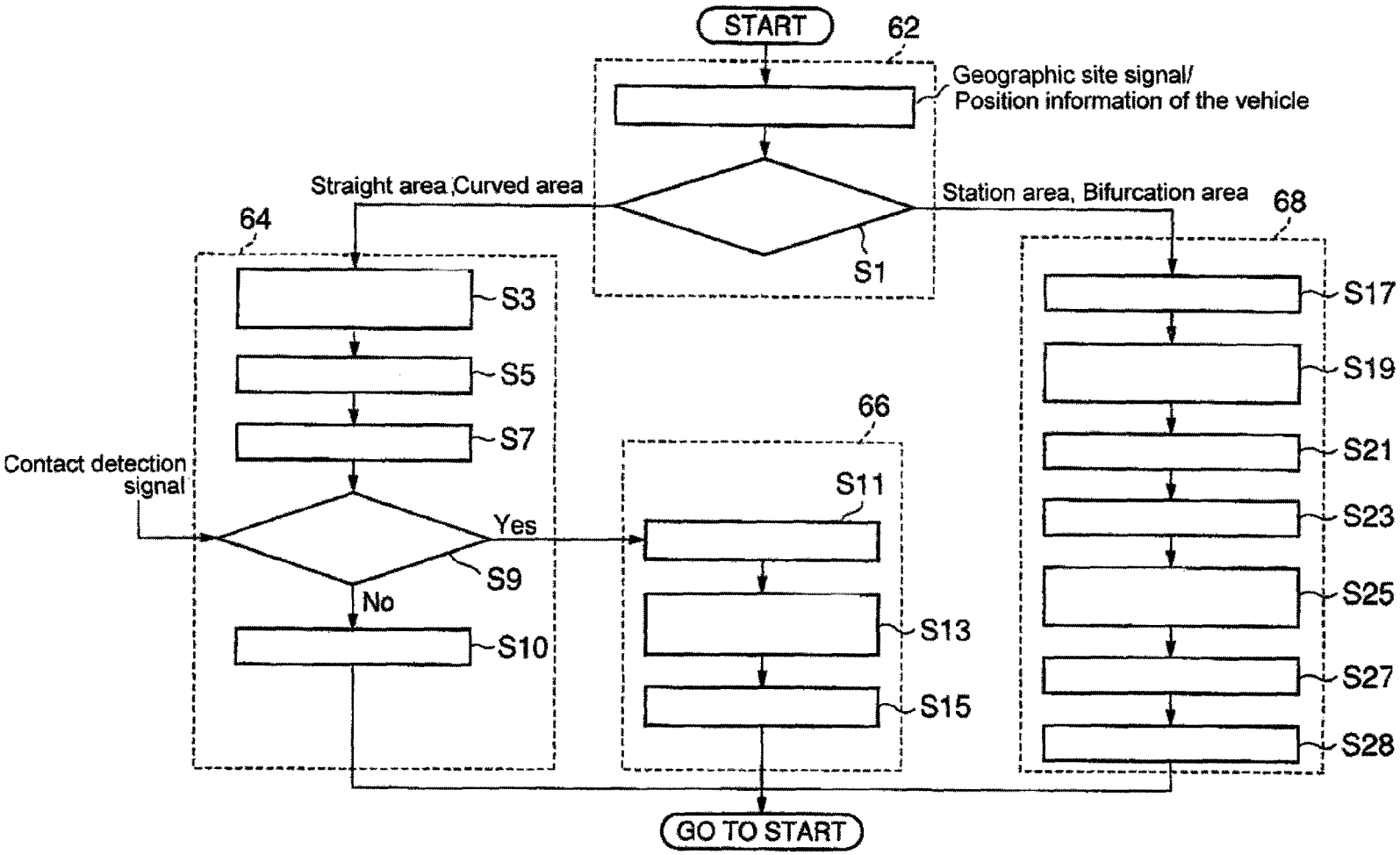
FIG. 5 is a flowchart of vehicle traveling control process in the guided vehicle transportation system.
Figure 6:
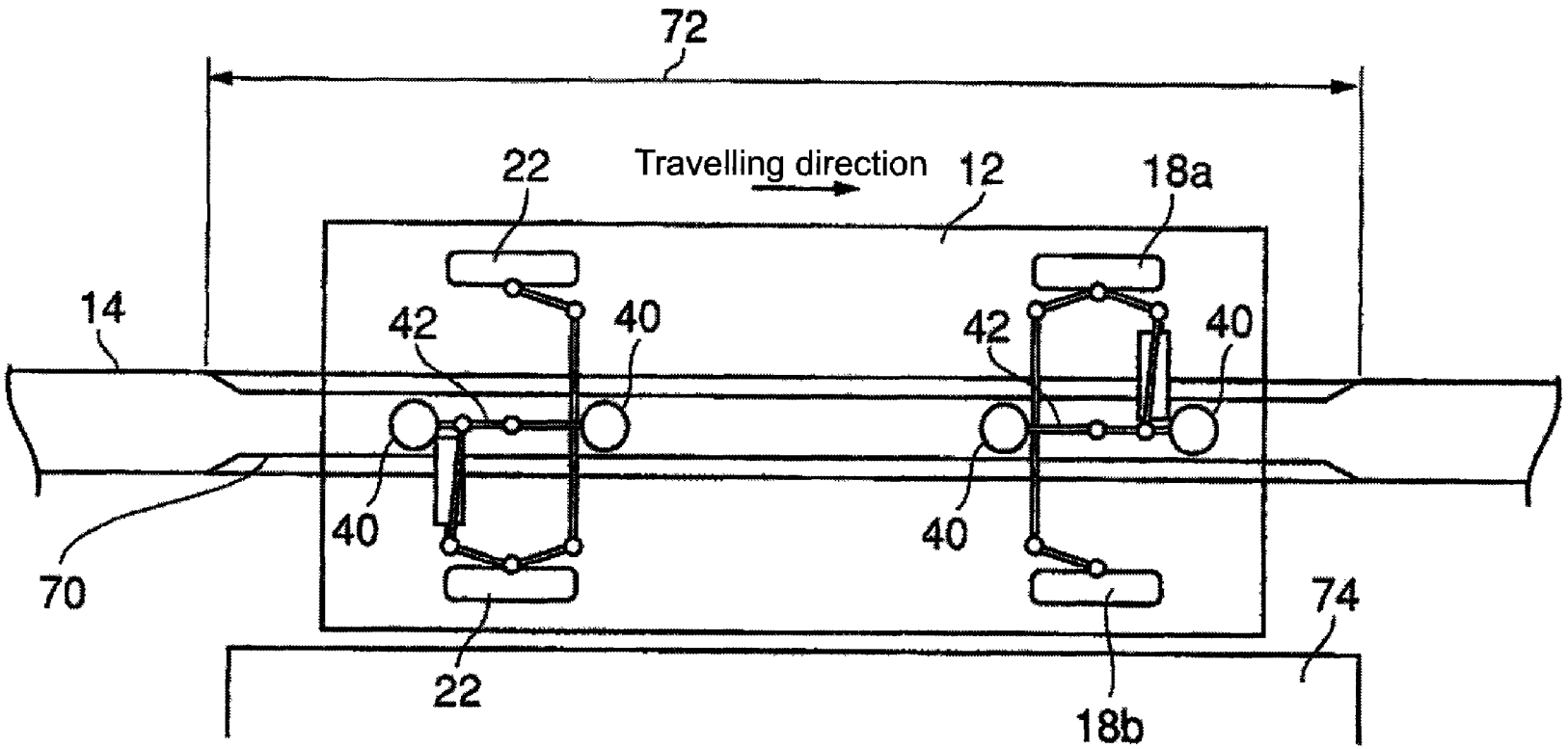
FIG. 6 is a drawing for explaining the vehicle attitude redressing in the guided vehicle transportation system.

A plan view of a guided vehicle transportation system is shown schematically in FIG. 1. FIG. 2 is a cross section taken along section line A-A in FIG. 1, FIG. 3 is an enlarged view of a part encircled by circle B in FIG. 2, FIG. 4 is a control block diagram of the steering system of the vehicle in the guided vehicle transportation system, FIG. 5 is a flowchart of vehicle traveling control process in the guided vehicle transportation system, and FIG. 6 is a drawing for explaining the vehicle attitude redressing in the guided vehicle transportation system.

As shown in FIGS. 1 and 2, a vehicle 12 adopted in the guided vehicle transportation system 10 travels along a guideway 01.

The guideway 01 consists of left and right roadbeds on which left and right traveling wheels 18*b* and 18*a* of the vehicle 12 travel, a depression formed between the roadbeds, and a guard rail 14 made of a channel-steel having a U-shaped groove laid down on the surface of the depression along the center line between the roadbeds so that the top of the guard rail is level with the surfaces of the roadbeds. It is preferable that a flange part 14*b* is formed at the top of each of the side walls of the groove to extend laterally toward the groove, although the flanges 14*b* are not indispensable in the transportation system.

The body of the vehicle 12 is suspended on a front bogie 16 and a rear bogie (not shown). To the front bogie 16 are attached right and left axles supported by means of king pins to be steerable to right and left, to the axels being attached front wheels 18 equipped with rubber tires of core type 20. To the right bogie are attached right and left axles supported by means of king pins to be steerable to right and left, to the axels being attached rear wheels 22 equipped with rubber tires of core type.

Next, a steering mechanism 26(see FIG. 4) will be explained concerning that for the front wheels 18. That for the rear wheels 22 is of the same construction.

As shown in FIG. 1 and FIG. 2, a front steering arm 28*a* is connected to the front wheel 18*a* to extend frontward and a rear steering arm 30*a* is connected to the front wheel 18*a* to extend rearward. To the rear wheel 18*b* is connected a rear steering arm 30*b*. A tie rod 32 is connected to the rear ends of the rear steering arms 30*a* and 30*b* by means of spherical joints 34 respectively for rotation.

An end of a movable rod 38 of an actuator 36 is connected to the forward end part of the front steering arm 28*a* via a spherical joint 34 for rotation. The actuator 36 is attached to the front bogie 16. The actuator 36 is composed of an electric motor and ball screw feed mechanism, it is also suitable to adopt a pneumatic or hydraulic servo cylinder or linear motor.

A so-called Ackermann-Junt type link mechanism is composed by the tie rod 32, rear steering arms 30*a* and 30*b*, and angle of traverse of the right wheel and left wheel can be controlled adequately when turning.

Next, guard wheels 40 will be explained. Each of the guard wheels 40 is of a cylindrical shape and supported rotatably by a supporting arm 42 at the underside of the forward and rearward end parts thereof respectively. The guard wheels 40 are received in the U-shaped groove of the guard rail 14 so that their peripheries face the side walls of the groove. The guard rail 14 is preferably formed such that a flange 14*b* extends laterally toward the groove from both side walls of the guard rail 14 at the top thereof respectively as can be seen in FIG. 2.

The guard wheel 40 is preferably made of material having high vibration absorption property and high wear resistant property such as urethane rubber or material containing steel belt used in rubber tires.

Between the periphery of the guard wheel and the side walls of the groove of the guard rail 14 is provided a clearance respectively smaller than a permissible clearance (about 50 mm or smaller) so that deviation of the vehicle 12 to right or left is restricted in a limited value. In a normal state, the guard wheel 40 does not contact the side wall of the groove of the guard rail 14. Usually a total clearance of about 80 mm~100 mm is secured between the periphery of the guard wheel and the side walls of the guard rail.

The supporting arm 42 extending in the longitudinal direction of the vehicle is supported at its center by the bogie via a support shaft rotatably about the support shaft below the axels 44 of the front wheels 18.

The guard rail 14 be laid down on the surface of the guideway 15 as shown in FIG. 2 or laid down on the bottom of a depression formed along the guideway 15. By composing such that the supporting structure of the guard wheels 40 can be replaced according to the lay down condition of the guard rail, the system can accommodate flexibly to actual situations.

A connecting rod 46 connects the forward end of the front steering arm 28*a* and a point near the forward end of the supporting arm 42 so that the supporting arm 42 are directed in the same direction of the steered front wheels 20.

The steering mechanism 26 is comprised of the actuator 36, movable rod 38, front steering arm 28*a*, and rear steering arms 30*a*, 30*b*. An interlocking mechanism 48 is comprised of the forward supporting arm 42 and connecting rod 46.

The spherical joint 34 provided at the forward end of the front steering arm 28*a* is composed as a twin spherical joint 50 as shown in FIG. 3. An end of the movable rod 38 connected to a drive part 56 of the actuator 36 and an end of the connecting rod 46 are connected to the forward end of the front steering arm 28*a* by means of the twin spherical joint 50 in a state the movable rod 38 runs above the connecting rod 46. The end of the movable rod 38 is connected to an upper spherical joint 52 and the end of the connecting rod 46 is connected to a lower spherical joint 54 of the twin spherical joint 50. By adopting the twin spherical joint 50, effective utilization of space is possible.

Usually the actuator 36 is actuated on a steering directive signal from a control means 60 to apply steering force to the left front wheel 18*a*, and the steering force is transmitted from the front steering arm 28*a* to the right front wheel 18*b* via the rear steering arm 30*a* and tie rod 32. The steering force of the actuator 36 is also transmitted to the supporting arm 42 via the twin spherical joint 50 and connecting rod 46, and the supporting arm 42 is turned in accordance with the actuation of the actuator 36 so that the supporting arm 42 is turned to the same direction of the front wheels 18, that is, the center line connecting the centers of the both guard wheels 40 is brought to be directed in the same direction of the front wheels 18. Therefore, the vehicle 18 travels along the tramway with the guard wheels 40 not contacting the side walls of the guard rail 14.

Next, vehicle operation control will be explained referring to FIGS. 4-6.

As shown in a block diagram of a control system of FIG. 4, a geographic site signal on the track 01, position information of the vehicle, and contact detection signal are inputted to the control means 60.

The geographic site signal(geographic site information) is position information sent from non-excited on-ground devices 02 which are laid down at a subscribed spacing on the ground along all over the track 10 as explained in the description of the related art. The information sent from the on-ground devices 02 includes discrimination number of each on-ground device, its position information, track information, and control information. In the position information are included the absolute coordinate point of each on-ground device and distance form a reference point. It is suitable to use transponders as on-ground devices.

The position information of vehicle is a signal having information where the vehicle is positioned, the position of the vehicle being calculated using distance between the on-ground device 02 obtained by GPS(Global Positioning System), pulse signals of rotation numbers of the wheels, pulse signals of rotation numbers of the drive motor, etc. It is suitable to send position information of the vehicle from a monitoring center, commanding center, etc. by a radio signal.

The contact detection signal is a signal sent when a limit sensor attached to the supporting arm 42 or pulse sensors of rotation of the guard wheels or a steering force sensor provided on the steering mechanism 26, etc. detect that the guard wheels 40 contact the side wall 14*a* of the groove of the guard rail 14.

The control means 60 includes a track information judging means 62, a normal traveling control means 64 for controlling the steering mechanism 26 when the track information judging means 62 judges that the vehicle is traveling on a usual linear straight area or curved area of the guideway, a fail-safe means 66 for performing fail-safe control when the steering mechanism 26, etc. has experienced trouble, and a vehicle attitude redressing means 68 for redressing the attitude of the vehicle when the track information judging means judges that the vehicle is on a station area or bifurcation area of the guideway.

The control means 60 may be provided on the vehicle or in an off-vehicle space such as the monitoring center or commanding center thereby establishing a control system for collective controlling.

Next, control process will be explained referring a flowchart of FIG. 5. First, the track information judging means 62 makes judgments of the geographic site signal(geographic site information) based on the vehicle position information, etc.,(S1). The track information judging means 62 judges where the vehicle is and what part of the track the vehicle is traveling, for straight part or curved part or station area or bifurcation area of the guideway. The judging means 62 can judge beforehand the presence of a station, ramification point, sharp curve, etc. in several meters ahead of the vehicle.

When it is judged by the track information judging means 62 that the vehicle is traveling on a usual straight or curved part, control of the vehicle is performed by the normal traveling control means 64.

The normal traveling control means 64 detects where the vehicle is traveling and decide a steering pattern based on the current position of the vehicle and the track data memorized beforehand in a memory of the control means 60, (S3). Then automatic steering is switched on, (S5) to send automatic steering directive signal to the actuator 36 to commence automatic steering according to the steering pattern, (S7). Then the front wheels 18 are steered by means of the actuator 36 to guide the vehicle.

Whether the guard wheels 40 contact the guard rail 14 or not is judged based on the contact detecting signal during the vehicle is traveling under the automatic steering pattern, (S9). When a trouble happens to the steering mechanism 26, for example when the vehicle 12 is in danger of running off the guideway 01, the guard wheels 40 contact the guard rail 14 and a contact detection signal is sent out. YES or NO of reception of the contact detection signal is detected, and when YES, the steering mechanism is judged to be in trouble and control by the fail-safe means 66, and when NO, the steering mechanism is judged to be in normal operation and the automatic steering according to the steering pattern is continued, (S10).

The control by the fail-safe means 66 is performed such that, first the automatic steering is switched off to cancel the steering by the actuator 36 and the steering mechanism 26 is put in a free state. Then the front wheels 18 are steered by the movement of the supporting arm 42, which movement is restricted by the contact of the guard wheels 40 with the side wall 14*a* of the groove of the guard rail 14. That is, the vehicle 12 is guided by a mechanical feedback of the contact of the guard wheels 40 and guard rail 14, (S13). Then the steering command is reset, (S15).

In this way, safe traveling of the vehicle is guaranteed by providing the fail-safe means 66 even when trouble happens in the steering mechanism 26 of the vehicle 12, and safety and reliability of passenger transportation can be secured.

When it is judged by the track information judging means 62 that the vehicle is at a station or ramification point, or the vehicle is nearing the station or ramification point, control by the vehicle attitude redressing means 68 is performed.

The control by the vehicle attitude redressing means 68 is performed such that, first the automatic steering is switched off, (S17). Then, as shown in FIG. 6, when he vehicle 12 arrives at a vehicle attitude redressing section 72 where vehicle attitude adjusting members 70 are provided at the both side faces of the guard rail 14, the attitude of the vehicle 12 is redressed and reset forcibly by the vehicle attitude adjusting members 70 via the guard wheels 40. That is, the steering mechanism is reset in initial attitude by mechanically forced feedback and the attitude of the vehicle 12 is reset in the initial state on the guideway 01, (S19). Then the steering command is reset, (S21).

Then, when it is judged that the vehicle 12 passed the vehicle attitude redressing section 72 by a geographical site signal from the on-ground device 02, (S23), a steering pattern is newly determined based on the vehicle position information, (S25).

Then the automatic steering is switched on, (S27), and an automatic steering command according to the newly determined steering command is sent to the actuator 36 to commence automatic steering, (S28).

The width between the both side walls of the guard rail in the vehicle attitude redressing section 72 determined for the guard wheels 40 to contact the walls, concretively the width is determined to be larger by 1 mm~5 mm than the diameter of the guard wheel. The longitudinal length of the vehicle attitude redressing section 72 along the guard rail 14 is determined to be at least longer than the length of the vehicle, preferably 1-3 times the length of the vehicle.

Therefore, when the vehicle 12 passes the vehicle attitude redressing section 72, the guard wheels 40 contact the attitude adjusting members 70 provided to the side walls of the guard rail 14, as a result the direction of the supporting arm is redressed so that the guard wheels 40 can travel along the guard rail 14 without contacting the side walls of the guard rail 14. Therefore, when drifting to right or left or yawing of the vehicle occurs due to various disturbances, the attitude of the vehicle is redressed by the vehicle attitude redressing means 68 to the initial original attitude or desired attitude.

The vehicle attitude redressing sections 72 are preferably provided at a site just near a station in order to keep a correct clearance between the vehicle and the platform of the station and at a site just near a bifurcation and near a curved part of the guideway.

As has been described above, which of a straight area, curved area, station area, or bifurcation area of the guideway the vehicle traveling is judged by the track information judging means 62, and traveling of the vehicle is controlled by the normal traveling control means 64, vehicle attitude redressing means 68, or fail-safe means 66 is selected in accordance with the judgment, so safety and reliability of automatic steered traveling of the vehicle can be increased, and efficient and high speed traveling is made possible.

When malfunction occurs in the steering mechanism 26, the guard wheels 40 contact the side walls of the groove of the guard rail 14 and the vehicle 12 is guided by the guard rail 14, so safety and reliability of traveling of the vehicle can be secured even when malfunction occurs in the steering mechanism 26.

As the steering mechanism is composed such that traveling wheels of both the of right and left sides are turned to direct the same direction at the same time by the combination of the tie rod 32, front steering arms 28, rear steering arm 30, connecting rod 46, actuator 36, steering of wheels is performed with certainty.

The First Embodiment

Figure 7:
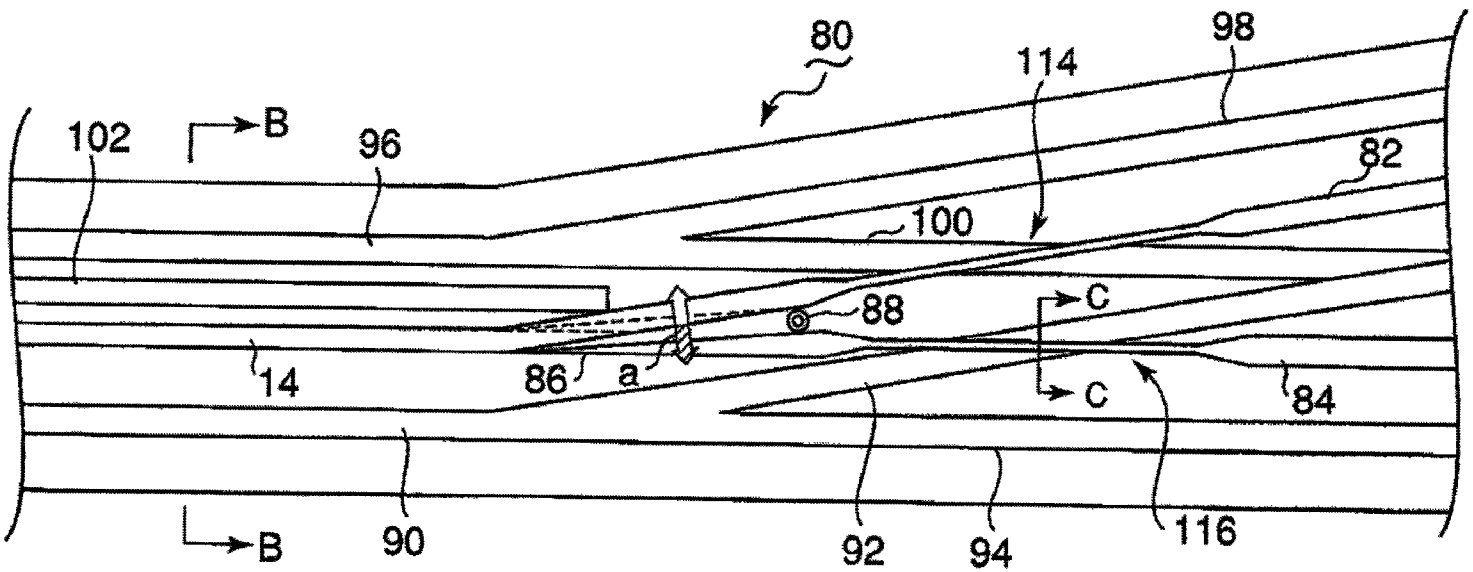
FIG. 7 is a plan view of a bifurcation area of guideway to which the structure of crossover site of the first embodiment of the present invention is applied.
Figure 8:
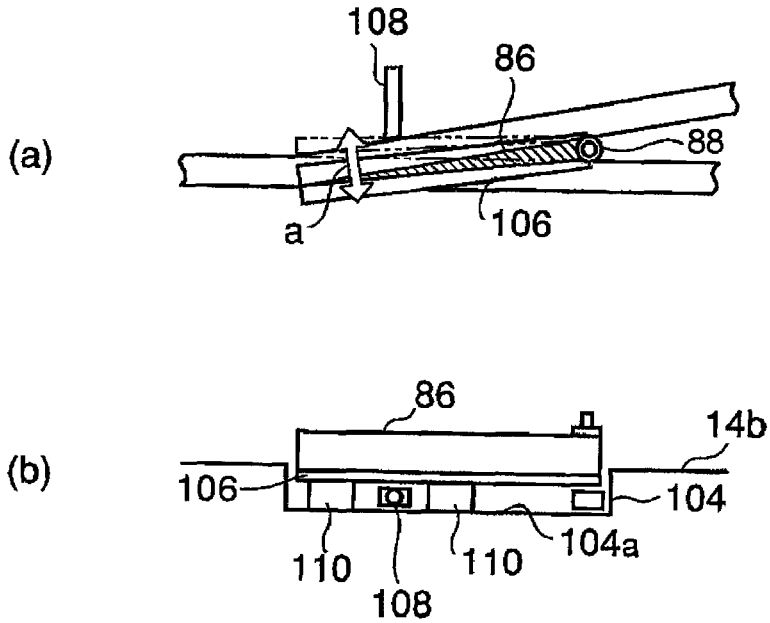
FIG. 8*a* is a plan view of the bifurcation area of guideway showing a laterally swingable guard plate in the first embodiment.
FIG. 8*b* is an elevational view thereof.
Figure 10:
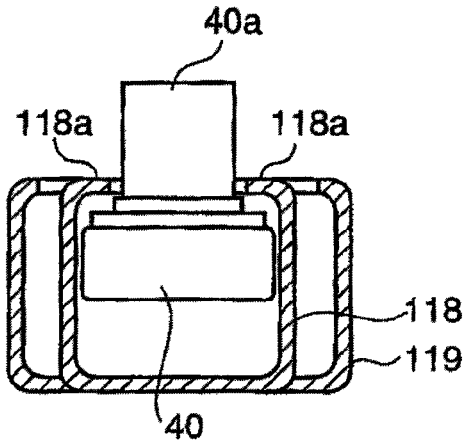
FIG. 10 is a cross section taken along section line C-C in FIG. 7.
Figure 11:
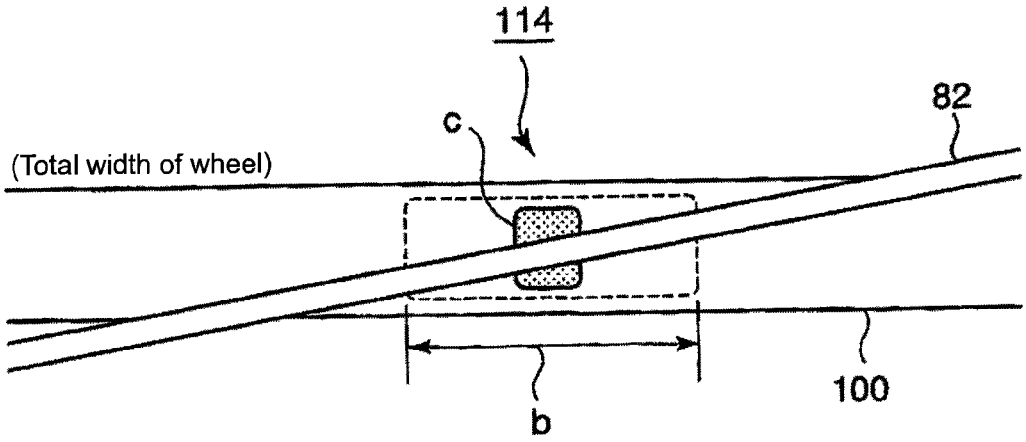
FIG. 11 is plan view showing the tread of tire of a traveling wheel on a roadbed at a part at which the guard rail crosses the roadbed in the first embodiment.
Figure 12:
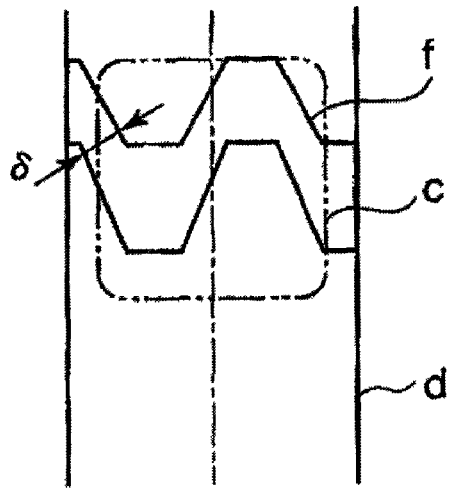
FIG. 12*a* is a plan view of a usual joint part of the roadbed.
FIG. 12*b* is an enlarged plan view of the crossing part of the guard rail and roadbed in FIG. 11.
Figure 12:
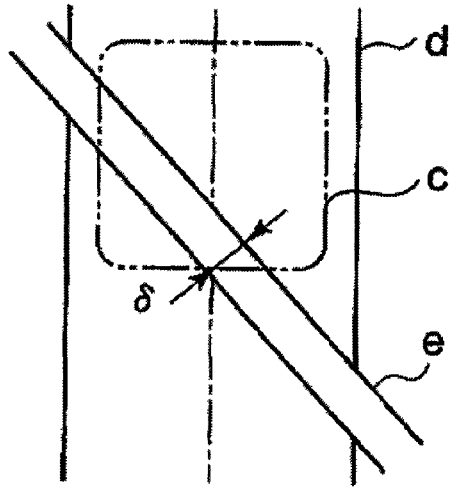

Structure of bifurcation of the guideway of a first embodiment will be explained referring to FIGS. 7 to 12. FIG. 7 is a plan view of a bifurcation of the guideway, FIG. 8*a* is a plan view of a swingable guard plate, FIG. 8*b* is an elevationinal view thereof, FIG. 9 is a cross section taken along section line B-B in FIG. 7, FIG. 10 is a cross section taken along section line C-C in FIG. 7, FIG. 11 is plan view showing the tread of tire of a traveling wheel on the roadbed at which the guard rail crosses the roadbed in the first embodiment, FIG. 12*a* is a plan view of a conventional joint part of the roadbed, and FIG. 12*b* is an enlarged plan view of the crossing part in FIG. 11.

Referring to FIG. 7, the guard rail 14 branches off in two guard rails 82 and 84 at a bifurcation area 80 of the guideway 01. At the bifurcation of the guard rail is provided a laterally swingable guard plate 86 swingably about a pivot point 88. At the bifurcation area 80, a right side(lower side in FIG. 7) roadbed 90 among both left and right roadbeds of the guideway 01 branches off in two roadbeds 92 and 94, and a left side (upper side in FIG. 7) roadbed branches off in two roadbeds 98 and 100. A signal signal line 102 for transmitting a variety of signals to the vehicle is embedded underground at the bifurcation area 80 of the guideway 01.

As shown in FIGS. 8*a* and 8*b*, a depression 104 is formed under the guide rail and the swingable guard plate 86 is provided to extend above the depression 104. A bottom plate 106 is attached to the underside of the swingable guard plate 86, and a switching rod 108 is connected to the plate 106 so that the guard plate 86 is swung by laterally moving the switching rod 108. The swingable guard plate 86 is supported on a supporter plate 110 fixed on the bottom 104*a* of the depression 104. By moving the switching rod 108 laterally in directions a by means of a driving means not shown in the drawing, the swingable guard plate 86 is swung about the pivot point 88 so that the connection of the groove of the guard rail 14 to the groove of one of the branched guard rail is selected. With this composition, the groove of the guar rail 14 is connected to either one of the guard rail 82 or 84 smoothly without a step. Therefore, when the guard wheels received in the groove of the guard rail 14 come to the bifurcation, the guard wheels 40 can proceed to either one of the branched grooves smoothly, and vice versa, that is, when the guard wheels received in either one of the grooves of the guard rail 82 or 84 come to the bifurcation, the guard wheels 40 can proceed to the groove of the guard rail 14.

Figure 9:
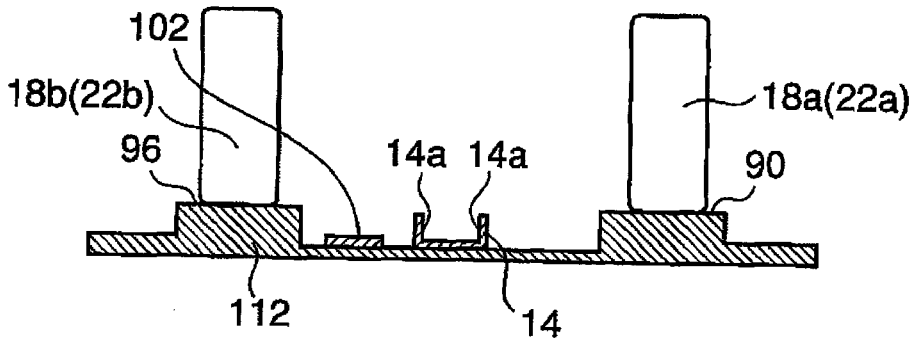
FIG. 9 is a cross section taken along section line B-B in FIG. 7.

In FIG. 9, roadbed 90 and 96 on which the right and left traveling wheels 18*a* and 18*b* travel respectively are formed on the roadbed 112 of the guideway, and the guard rail 14 is laid down on the bottom of a depression formed between the roadbed 90 and 96 along the center line of the depression. A signal line 102 is also laid down on the bottom of the depression.

Back to FIG. 7, at a crossing part 114 where the guard rail 82 crosses a roadbed 100 which branched from the roadbed 96, the width of the groove of the guard rail 82 is narrowed to a minimum width that the guard wheels 40 can pass through. Also at a crossing part 116 where the guard rail 84 crosses a roadbed 94 which branched from the roadbed 90, the width of the groove of the guard rail 84 is narrowed to a minimum width that the guard wheels 40 can pass through.

In FIG. 10 are shown a cross section of the narrowed part 118 of the guard rail at the crossing part 114(116) and that of the normal guard rail part 119 together for comparison sake. For example, width of the groove of the normal guard rail part 119 is determined to be 250 mm when the diameter of guard wheel 40 is 150 mm, whereas the width of the groove of the narrowed part 118 is determined to be 152 mm with a clearance of 1 mm between the periphery of the guard rail and side walls of the guard rail 118. Flange part 118*a* extending laterally toward the groove are formed at the top end of the rail, and width between the ends of the flanges 118*a*, i.e. width of the opening of the groove of the narrowed part of the guard rail 118 is narrowed to be 100 mm.

In FIG. 11 is shown the tread c of tire of a traveling wheel on the roadbed 100 at the crossing part at which the guard rail 82 crosses the roadbed 100.

In FIG. 12*a* is shown a conventional joint part where roadbeds continue with a gap, and FIG. 12*b* shows a joint part in the system of the invention. In FIG. 12*a*, convex and concave type joint part f is formed with a gap of δ. That the traveling wheel can pass over the joint part of FIG. 12*a* smoothly without the traveling wheel bitten into the gap when the gap is 100 mm is verified by actual operation.

In the case of FIG. 12*b* of the present invention, the width e of the opening of the narrowed part of the guard rail which crosses a roadbed diagonally is determined to be 100 mm, for example, as mentioned above. When the width δ is 100 mm, the traveling wheel 40 can pass over the guide rail smoothly without the wheel 40 bitten into the opening of the groove of the narrowed part of the guide rail 118.

According to the embodiment, by providing the swingable guard plate 86 at the branching part of the guard rail 14 in the bifurcation area 80, the guard wheels 40 can proceed to the groove of either one of the branched guard rail 82 or 84 selected by swinging the swingable guard plate 86 and vice versa with certainty. This is achieved with certainty also when malfunction occurs in the steering mechanism 26 or any external force exerts on the vehicle when the vehicle passes the bifurcation area 80. Although operation of the steering mechanism is switched off when the vehicle 12 approaches the bifurcation area 80 as described previously, the vehicle may be allowed to pass the bifurcation area 80 with the steering mechanism switched on.

When the vehicle 12 travels with the automatic steering systems switched on, the guard wheels do not contact the side walls of the groove of the guard rail and the swingable guard rail, the vehicle can pass the bifurcation of the guard rail smoothly and occurrence of troubles is reduced.

The Second Embodiment

Figure 13:
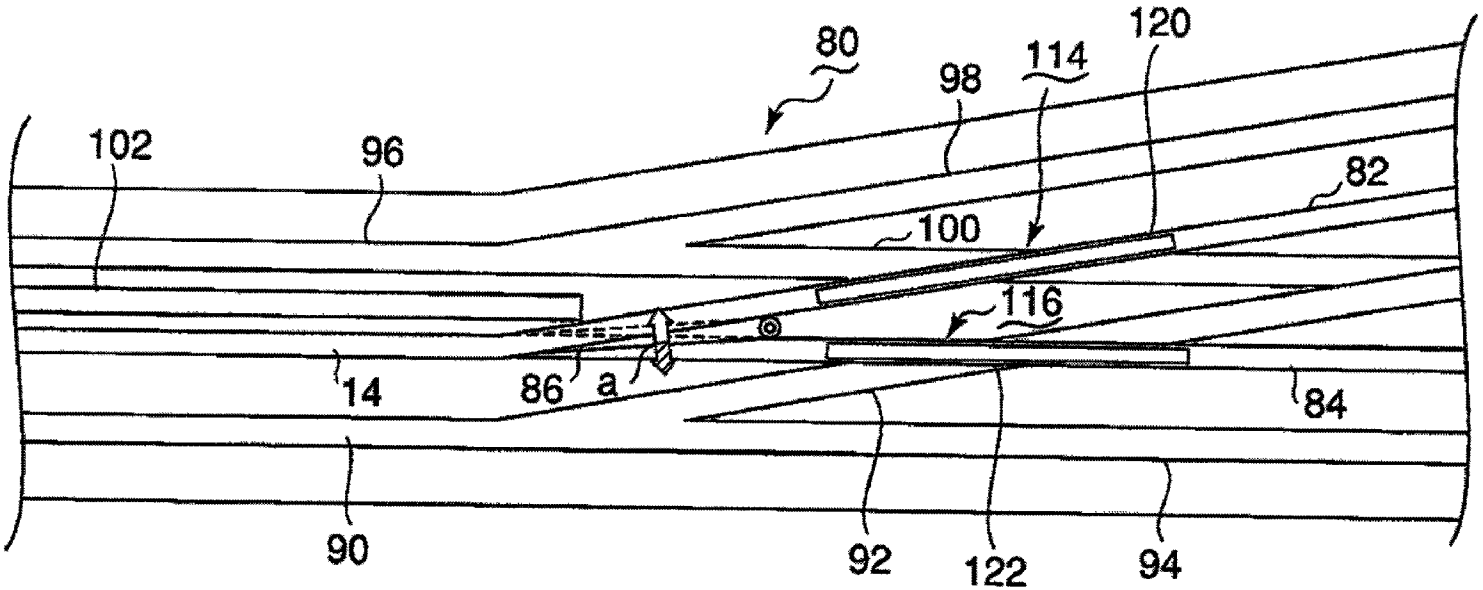
FIG. 13 is a plan view showing the structure of the bifurcation area of the second embodiment of the present invention.
Figure 14:
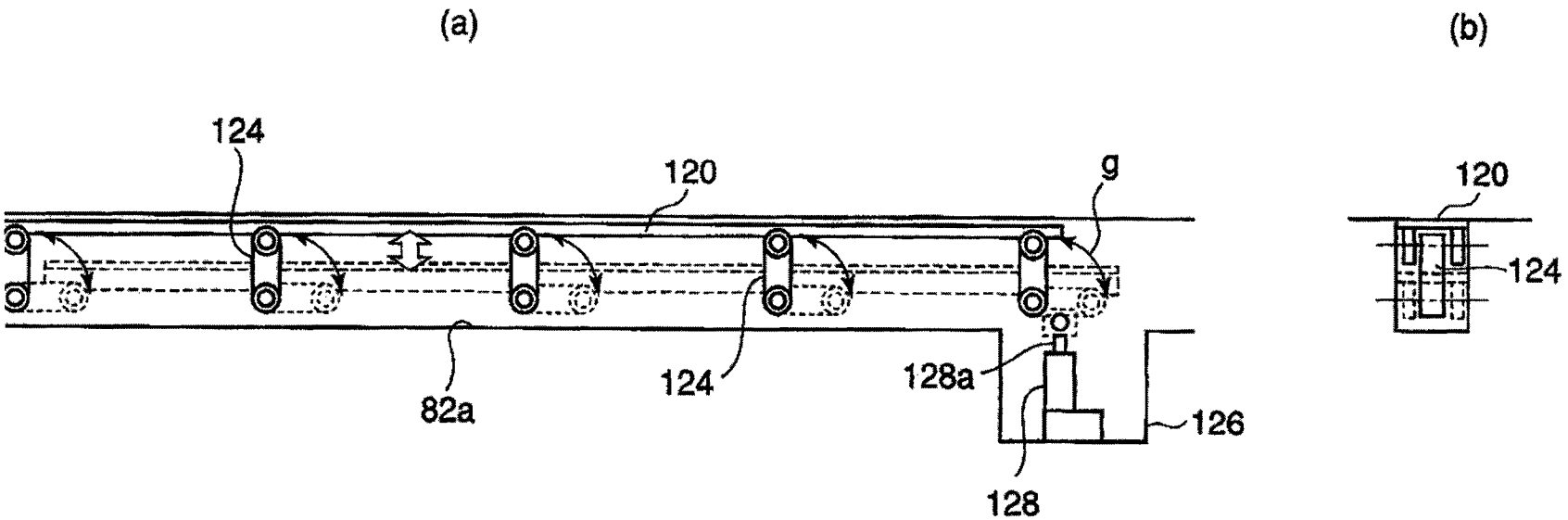
FIG. 14*a* is a side elevational view showing the drive mechanism for driving the tread plate in the second embodiment.
FIG. 14*b* is a cross sectional view of FIG. 14*a*.

Next, a second embodiment of the invention will be explained referring to FIGS. 13-15. In FIGS. 13-14, components and devices the same as those of the first embodiment are indicates by the same reference numerals and explanation is omitted. As can be seen in FIG. 13 showing a plan view of the bifurcation 80, a tread plate 120 is provided along the groove of the guard rail 82 at the crossing part 114 of the guard rail 82 crossing the roadbed 100 of the branched guideway, and a tread plate 122 is provided along the groove of the guardrail 84, which branched off from the guard rail 82, at the crossing part 116 of the guard rail 84 crossing the roadbed 92 of the branched guideway. Construction of the guideway other than mentioned above is the same as that of the first embodiment.

Construction of the tread plate 120 including its drive mechanism is shown in FIG. 14*a* and FIG. 14*b*. The tread plate 122 is composed the same as the tread plate 120 including the drive mechanism. The construction of the tread plate is shown in FIG. 14*a* in side elevational view and in FIG. 14*b* in front elevational view. Referring to the drawings, an end of each of a plurality of links 124 is connected to the underside of the tread plate 120 by a pivot and the other end thereof is connected to the side wall of the guard rail 82 by a pivot. The plurality of links 124 are provided along the longitudinal direction of the tread plate 120 at certain spacing. A depression 126 is provided under the bottom 82*a* of the guard rail 82 at a region of one of the link 124. An electric cylinder 128 is installed in the depression. A cylinder rod 128*a* of the electric cylinder 128 is connected to said one of the links 124 so that the links 124 can be rotated in the directions g, by which the tread plate 120 is moved down and moved up. When the traveling wheel passes on the crossing part 114 with the guard wheels received in the groove of the guard rail 84, the tread plate 120 is moved up so that the upper surface of the tread plate is level with the surface of the roadbed 100, and when the guard rails proceed along the groove of the guard rail 82, the tread plate 120 is moved down in order not to prevent proceeding of the guard wheels in the groove of the guard rail 82.

Preferably a stopper is provided so that the tread plate is supported by the stopper at a position the kinks 124 is rotated a little short of vertical position so that the load from the traveling wheel does not exert on the electric cylinder 128 directly.

Figure 15:
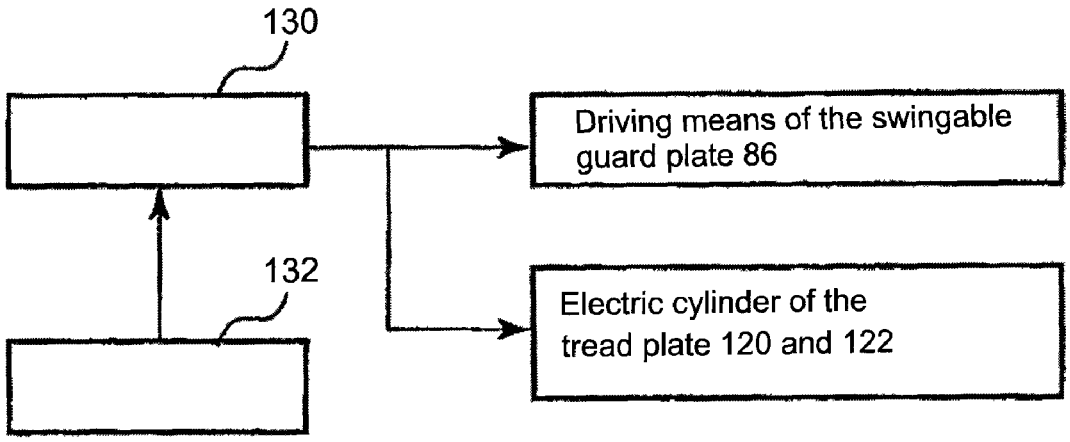
FIG. 15 is a block diagram of controlling the laterally swingable guard guide plate and the tread plate in the second embodiment.

FIG. 15 is a block diagram of controlling the swingable guard guide plate 86 and the tread plate 120(122). When a vehicle position detecting means 132 detects the vehicle 12 approaching the bifurcation 80, it sends a signal to a controller 130 provided in an on-ground control room. The controller 130 controls driving means of the swingable guard plate 86 and the tread plate 120 and 122 upon receiving the signal.

When the vehicle comes to the bifurcation 80 of the guideway and the swingable guard plate 86 is driven to allow the guard wheels to proceed to the groove of the guard rail 82, the tread plate 120 is retained in the descended position and the tread plate 122 moved up so that the upper surface thereof is level with the surface of the roadbed 92. Thus, the laterally swingable guard plate 86, and the tread plates 120, 122 are controlled in association with one another. The vehicle 12 travels with the guard wheels 40 received in the groove of the guard rail 82, the left traveling wheels traveling on the roadbed 98 and right traveling wheels traveling on the roadbed 92. As the tread plate 122 is level with the surface of the roadbed 122 at the crossing part 116 where the guard rail 84 crosses the roadbed 92, the right traveling wheels can pass the crossing part 116 smoothly.

According to the embodiment, the vehicle 12 can enter the scheduled branching road with the guard wheels guided by the swingable guard rail 86, and further the traveling wheels can travel smoothly on the roadbeds by providing tread plate 120 and 122 which can plug the opening of the groove of the guard rail 82 or 84 crossing the roadbed 100 or 92 at the crossing part 114 or 116 on which the traveling wheels of left or right side proceed at the crossing part 114 or 116, and the vehicle 12 can pass the bifurcation area 80 of the guideway very smoothly.

The Third Embodiment

Figure 16:
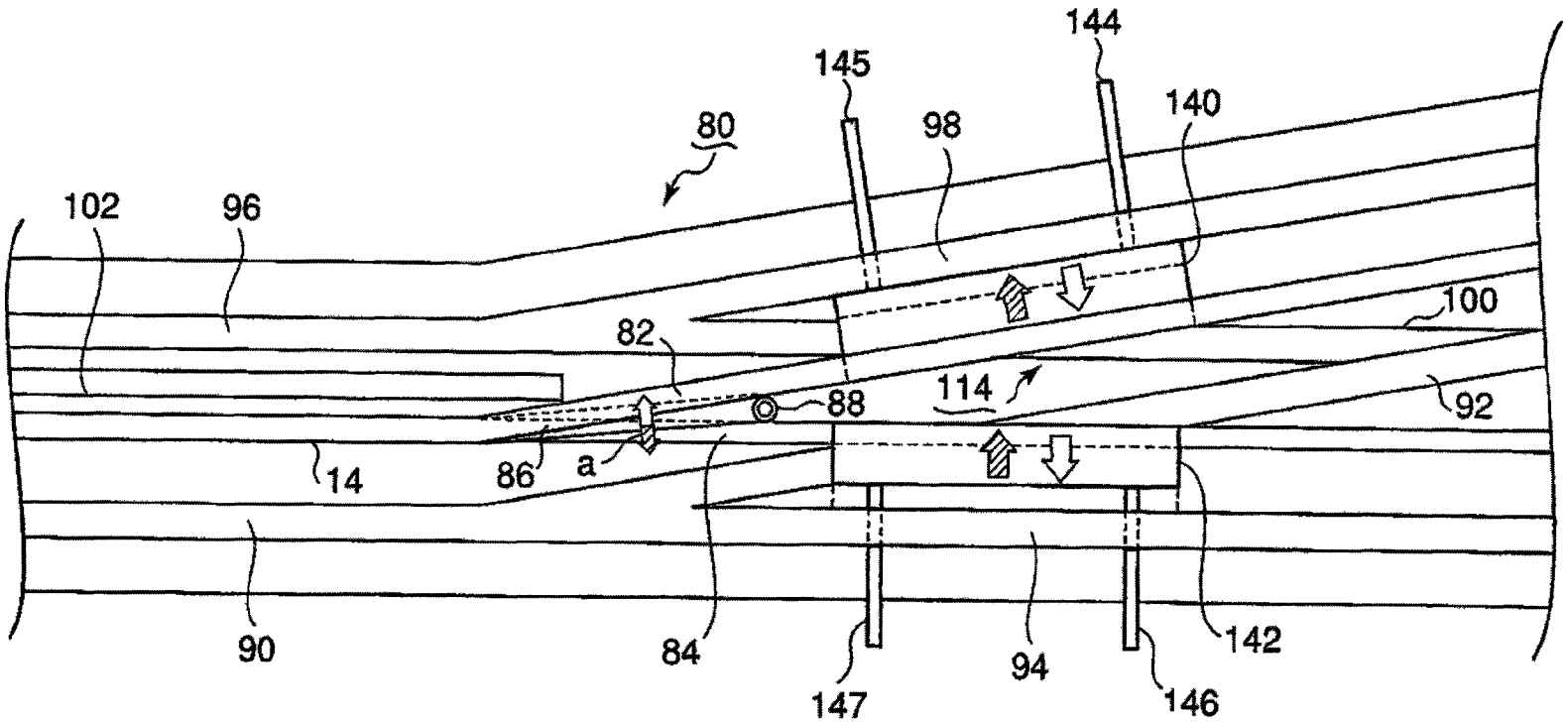
FIG. 16 is a plan view showing the structure of the bifurcation area of the third embodiment of the present invention.

Next, a third embodiment of the invention will be explained referring to FIG. 16 showing a plan view of the bifurcation area 80 of the guideway. In FIG. 16, constituent parts the same as those of the first embodiment are designated by the same reference numerals and explanation will be omitted. In FIG. 16, a laterally slidable plate 140 is provided at the crossing part 114 where the branched guard rail 82 crosses the roadbed 100, and a laterally slidable plate 142 is provided at the crossing part 116 where the branched guard rail 84 crosses the roadbed 92.

The laterally slidable plates 140 and 142 are provided so that the upper surfaces thereof are level with the surfaces of the roadbed 100 and 92 respectively, and two actuating rods 144, 145, and 146, 146 are attached to one side of each of the laterally slidable plates respectively. These actuating rods are connected to drive means such as electric cylinders not shown in the drawing so that the laterally slidable plates 140 and 142 can be moved by pushing or pulling them by the actuating rods.

In the embodiment, also the controller 130 is provided to control the laterally swingable guard plate 86 and the laterally slidable plates 140 and 142 in association with one another when the approach of the vehicle 12 to the bifurcation 80 is detected as shown in FIG. 15.

With the composition of the third embodiment, when the vehicle 12 approaches the bifurcation 80, the laterally swingable guard plate 86 and laterally slidable plates 140, 142 are controlled in association with one another by the controller 130 so that the opening of the groove of the guard rail 82 or 84 at the crossing part 114 or 116 is covered by the laterally slidable plate 140 or 142, and the vehicle 12 can pass the bifurcation area 80 of the guideway very smoothly.

The Fourth Embodiment

Figure 17:
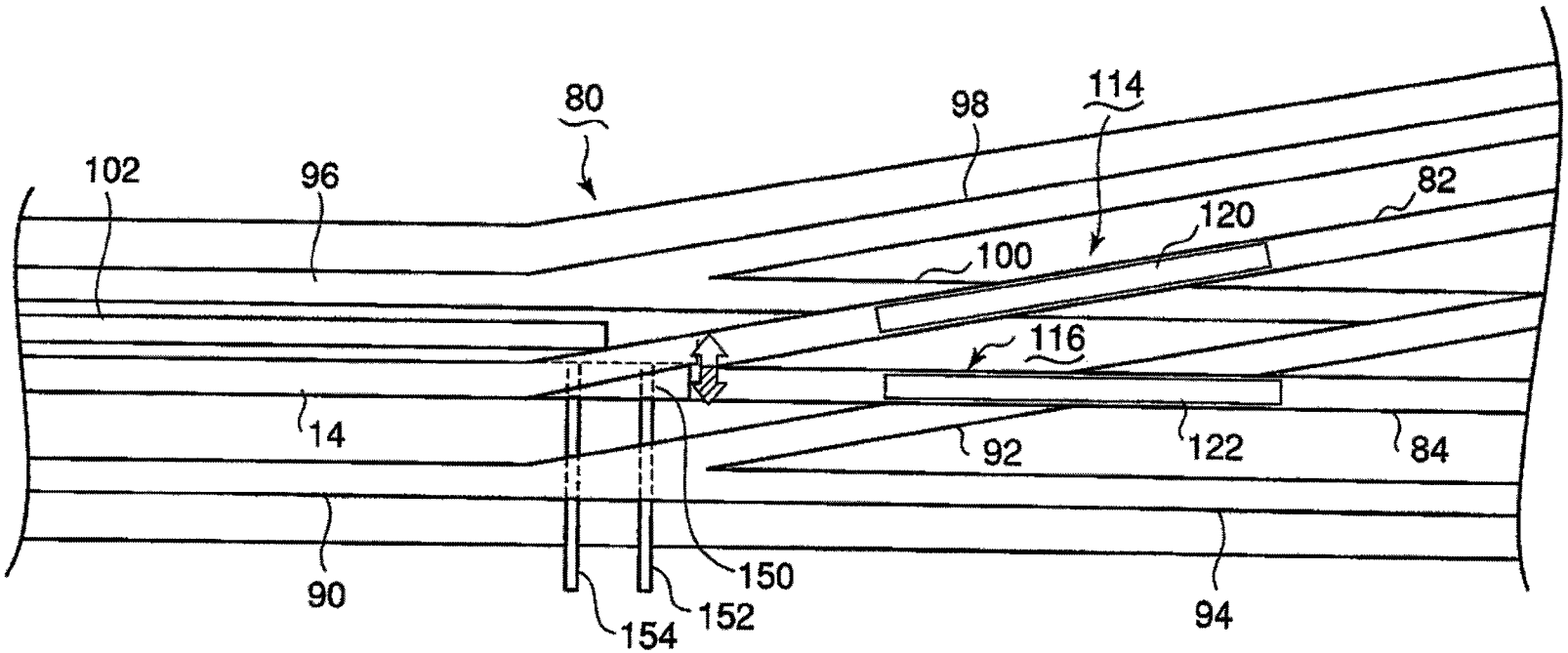
FIG. 17 is a plan view showing the structure of the bifurcation area of the fourth embodiment of the present invention.
Figure 18:
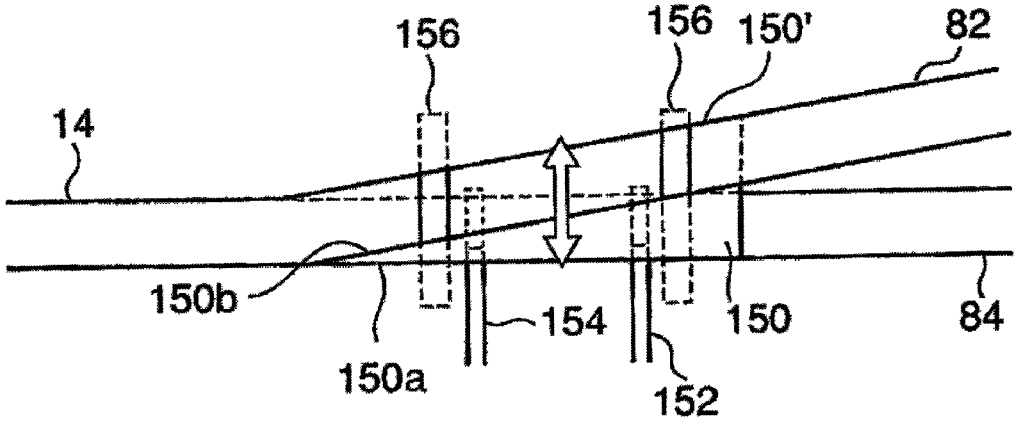
FIG. 18 is an enlarged plan view of the branching part of the guard rail in the fourth embodiment.

Next, a fourth embodiment of the invention will be explained referring to FIGS. 17 and 18. FIG. 17 is a plan view of a bifurcation area and FIG. 18 is an enlarged plan view of a branching part of the guard rail. In FIGS. 17 and 18, constituent parts the same as those of the second embodiment shown in FIG. 13 are designated by the same reference numerals and explanation will be omitted. Referring to FIGS. 17 and 18, a right triangular prism-shaped laterally slidable guard member 150 is provided at the branching part of the guard rail 14. The laterally slidable guard member 150 is connected to an end of each of rods 152 and 154, and the ether end of each of the rods 152 and 154 is connected to a drive means such as an electric cylinder not shown in the drawings. Support plates 156 for supporting the slidable guard member 150 on the upper surface thereof are provided under the slidable guard member 150. Composition other than that mentioned above is the same as that of the second embodiment and the tread plate 120 and 122 are provided at the crossing parts 114 and 116 as are in the second embodiment.

With the composition, the guard wheels of the vehicle can proceed either one of the branched guard rail 82 or 84 branching from the guard rail 14 by sliding the slidable guard member in directions indicated by an arrow in the drawings. As can be seen in FIG. 18, when allowing the guard rail 14 to continue to the guardrail 82, the slidable guard rail 150 is moved down so that the base face 150*a* of the right triangular prism 150 is brought into contact with the downside wall of the guard rail 84 and the slant face 150*b* continues to the downside wall of the guard rail 82 smoothly without a step. When allowing the guard rail 14 to continue to the guard rail 84, the slidable guard rail 150 is moved up so that the slant face 150*b* of the right triangular prism 150 is brought into contact with the upside wall of the guard rail 82 and the base face 150*a* continues to the upside wall of the guardrail 84 smoothly without a step.

In the embodiment, also the tread plates 120 and 122 shown in FIG. 13 showing the second embodiment are provided at the crossing parts 114 and 116, and the vehicle can pass the crossing parts smoothly.

Next, other examples of configuration and structure of the branching part and crossover part of the groove of the guard rail applicable to the invention in guided vehicle transportation system and steering of the vehicle when the vehicle passes the branching part of the guard rail will be explained.

Figure 19:
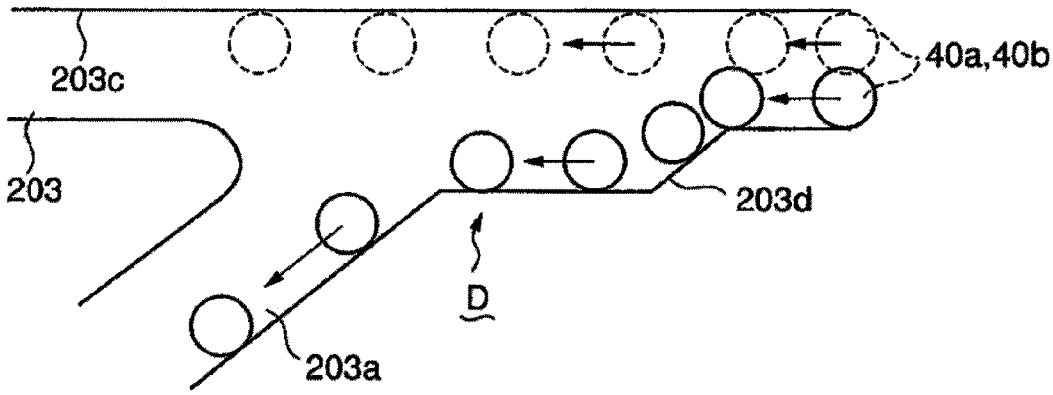
FIG. 19 is a plan view of an example of configuration of a branching part of the guard rail.

FIG. 19 is a plan view of an example of configuration of the branching part of the guard rail. A side recess D of the guard rail 203 is formed at a Y-shaped bifurcation, the side wall of the recess D having an oblique side wall 203*d* continuing to a side wall opposite to the side wall 203*c* of the guard rail 203. When the vehicle advances straight ahead from the right to left in the drawing, the vehicle is steered so that both guard wheels 40*a* and 40*b* supported by the arm 42(see FIG. 1) contact the side wall 203*c* of the guard rail 203 as shown by circles of broken lines. When allowing the vehicle to travel along the branched guard rail 203*a*, the vehicle is steered so that the guard wheels 40*a* and 40*b* advance contacting the side wall opposite to the side wall 203*c* and then contacting the oblique side wall 203*d* and the bottom side wall of the side recess D as shown by circles of solid lines.

By steering the vehicle as mentioned above at a Y-shaped bifurcation formed to have the side recession D, the vehicle can travel in its intended direction at the bifurcation only by means of the automatic steering mechanism and fail-safe mechanism without necessity of providing switching apparatuses such as the lateral sliding plate 86 and driving mechanism thereof.

Figure 20:
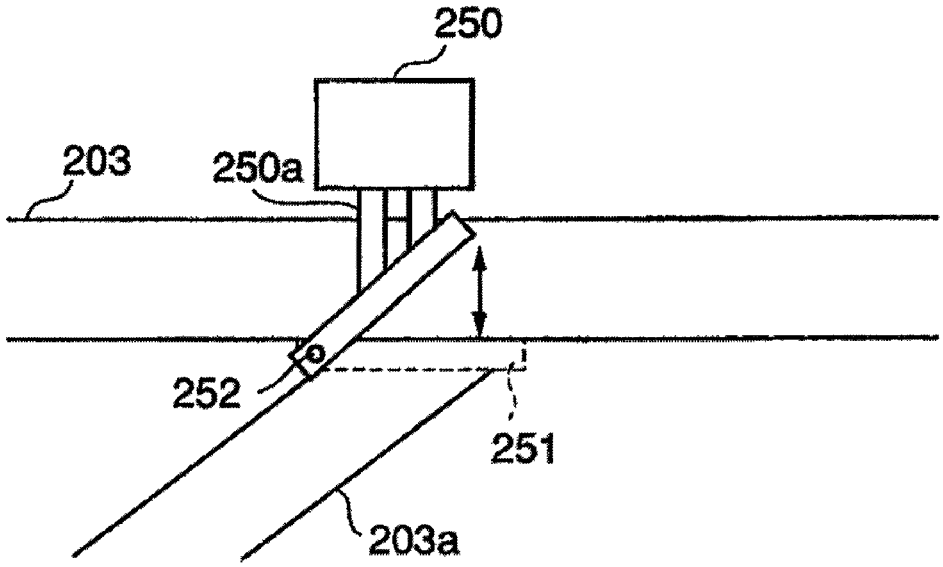
FIG. 20 is a plan view of another example of structure of the branching part of the guard rail provided with another type of laterally swingable guard plate different from that of the first embodiment shown in FIGS. 7 and 8.

Next, another example of structure of the branching part of the guard rail will be explained referring to FIG. 20 showing a plan view thereof. In FIG. 20, reference numeral 250 is an electric cylinder located outside the guard rail 203. Cylinder rods 250*a* are connected to a swingable guard plate 251 via a slider (not shown) so that the guard plate 251 can be swung about a pivot 252 by the reciprocation of the cylinder rods 250*a* to shut the guard rail 203 or branched guard rail 203*a* by the actuation of the electric cylinder 250. The electric cylinder 250 is provided with a lock mechanism to lock the guard plate 251 in a state it shuts the guard rail 203 or branched guard rail 203*a*.

With the bifurcation device of this composition, the guard plate 251 can be driven easily and accurately with simple construction.

Figure 21:
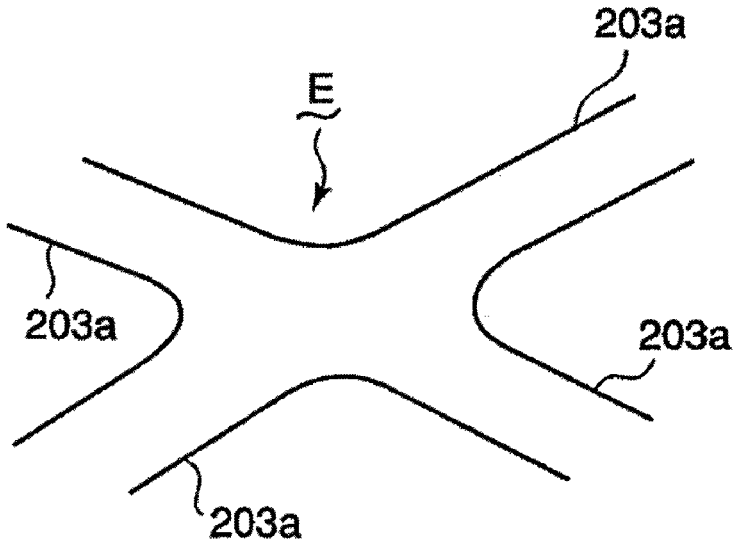
FIG. 21 is a plan view of an example of configuration of an X-shaped crossover part of the guard rail.

A crossover site shown in FIG. 21 is an example of X-shaped crossover part E of the guard rail where the guard rails 203*a* crosses each other. The guard rails 203*a* are narrowed in width of the groove thereof at the X-shaped crossover part E as compared with the groove of the guard rail 203 such as shown in FIG. 20 and corners are rounded. By narrowing the width of the groove of the guard rail at the X-shaped crossover site, the guard wheels of the vehicle can pass the crossover site more stably, as the swing of the supporting arm 42 supporting the forward and rear ward guard wheels 40*a* and 40*b* is more restricted by the contact of the guard wheels to the side walls of the guard rails as compared with the case the width of the groove of the guard rail is wide.

Figure 22:
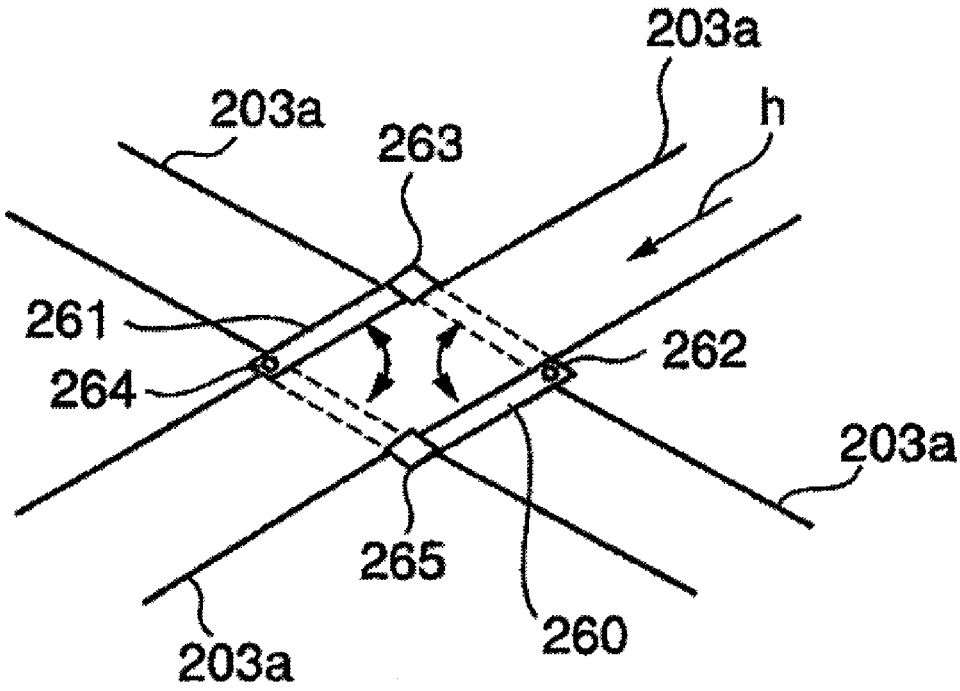
FIG. 22 is a plan view of another example of structure of an X-shaped crossover part of the guard rail provided with two laterally swingable guard plates.

Next, another structure of an X-shaped crossover part of the guard rail will be explained referring to FIG. 22. In FIG. 22, swingable guard plates 260 and 261 are provided to be swingable about pivots 262 and 264 respectively. Reference numerals 263 and 265 are acceptor members for locking electromagnetically the guard plates 260 and 261. When the vehicle controlled by the automatic control mechanism to advance straight ahead in the direction h, the guard plates 260 and 261 are swung to be brought in the state shown with solid lines by drive mechanisms not shown in the drawing respectively and locked there electromagnetically. In this state, the vehicle can travel straight ahead passing the crossover site.

With the structure of the crossover part of the guard rail, each of the two swingable guard plates 260 and 261 can be swung individually to shut or open two among four openings of the groove of the guard rails 203*a* facing the crossover site selectively, the vehicle can be steered to select its course easily. Shutting opening of opening of the groove of the guard rail facing the X-shaped crossover site can be performed easily with simple construction.

Figure 23:
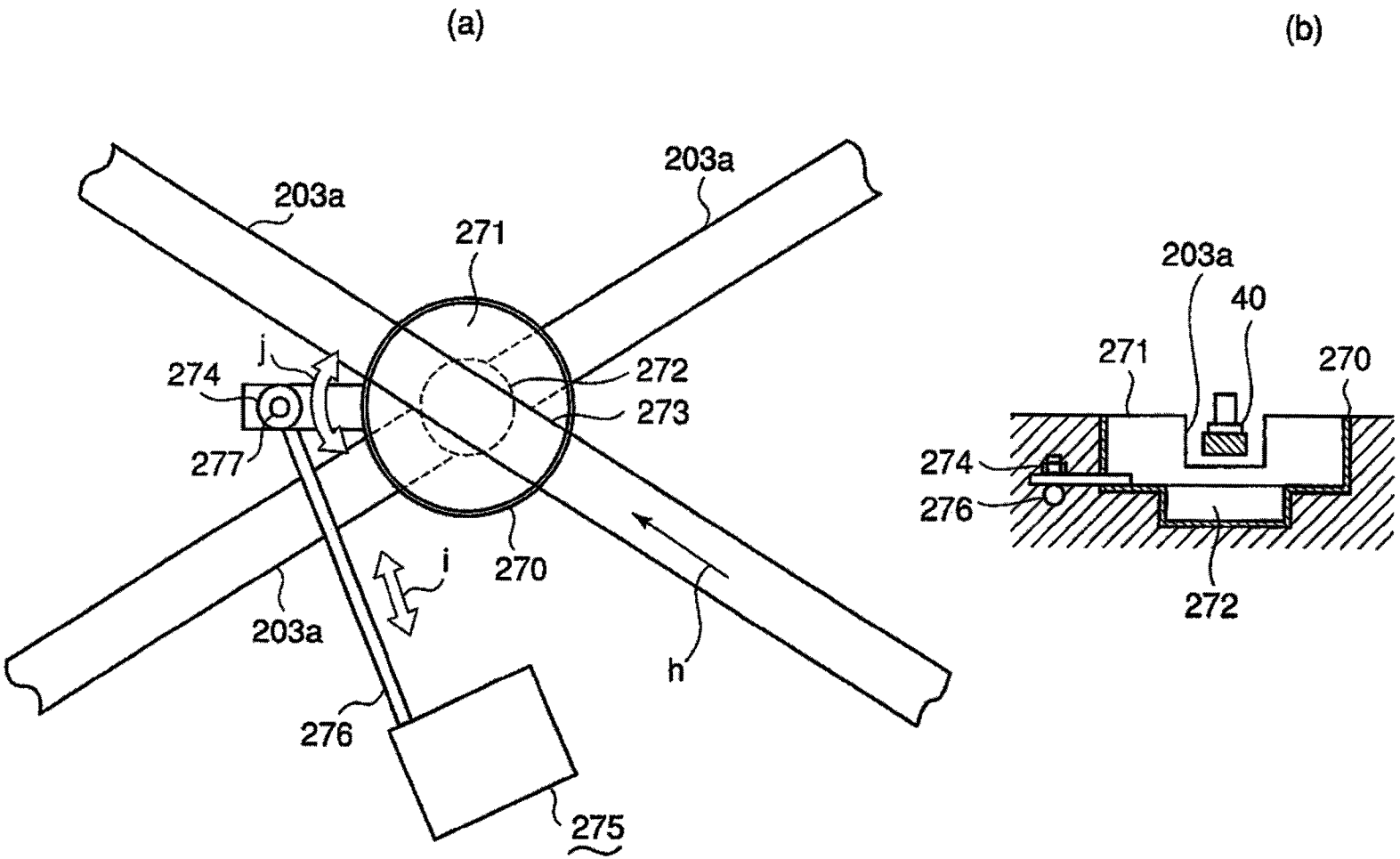
FIG. 23*a* is a plan view of yet another example of structure of an X-shaped crossover part of the guard rail provided with a swivel block.
FIG. 23*b* is an elevational view explaining swivel mechanism of the swivel block.

Yet another structure of an X-shaped crossover part of the guard rail will be explained referring to FIGS. 23*a* and 23*b*. FIG. 23*a* is a plan view and FIG. 23*b* is an elevational view. As shown in the drawings, a double-deck hollow cylindrical casing 270 is installed to extend into the ground at an X-shaped crossover site. The cylindrical casing 270 has an upwardly open hollow of larger diameter and a hollow smaller diameter closed with a bottom.

The casing 270 is installed in the ground so that the top thereof is level with the upper surface of the guard rail 203*a*. A swivel block 271 having a central shaft part 272 is received in the casing 270. A groove 273 of the same shape as the groove of the guard rail 203 is formed on the swivel block 271, the center line of the groove 273 intersecting the rotation center of the swivel block.

A bracket 274 is attached to the swivel block at a part of the periphery of the swivel block, and the bracket 275 penetrates a laterally extending opening formed at a part of the periphery of larger diameter of the casing 270.

An electric cylinder 275 is provided near the casing 270, and a connecting rod 276 connected to a cylinder rod of the electric cylinder 275 is connected to the bracket 274 via a pivot 277.

When the vehicle 12 approaches the X-shaped crossover site in the direction h and intends to pass the crossover site straight ahead, the swivel block 271 is rotated by means of the connecting rod 276 by actuating the electric cylinder 275 so that the groove 273 of the swivel block 271 coincides with the groove of the guard rail 203*a* along which the vehicle is approaching the crossover site. By this, the vehicle 12 can travel straight ahead passing the crossover site. When the vehicle 12 intends to turn to left or right, the swivel block 271 is rotated so that the groove of the swivel block 271 coincides with the groove of the guard rail crossing the guard rail along which the vehicle is approaching the crossover site.

With this switching device, selection of course at the X-shaped crossover part of the guard rail can be performed only by turning the swivel block 271, construction of the switching device can be simplified.

Figure 24:
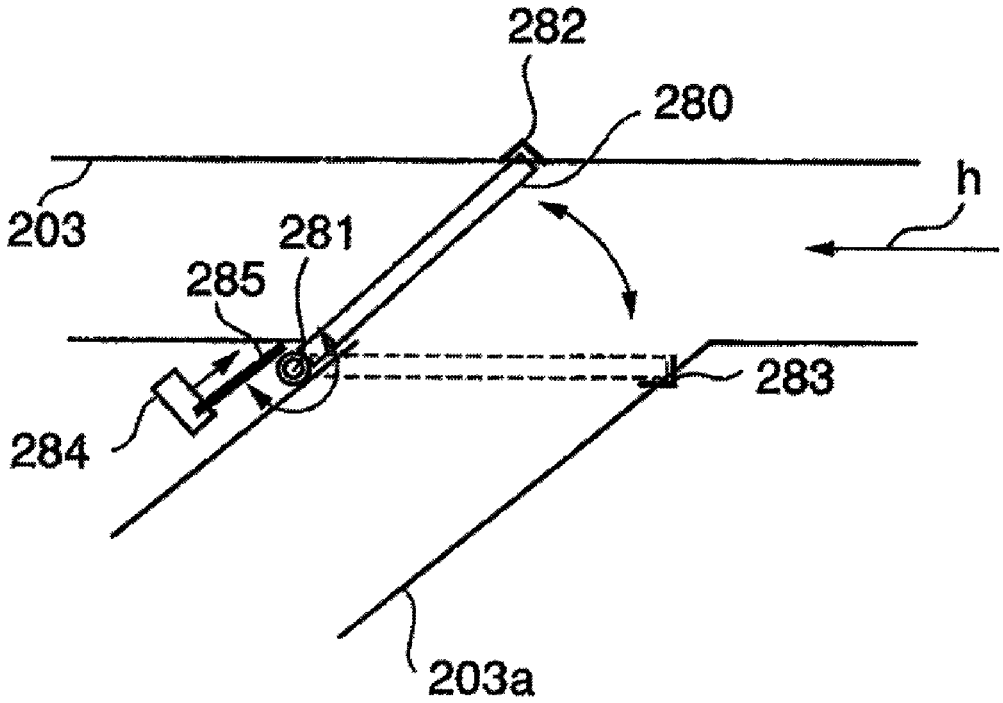
FIG. 24 is a plan view of yet another example of structure of the branching part of the guard rail provided with a laterally swingable guard plate driven by a rack-pinion point switching device.

Another example of structure of the branching part of the guar rail will be explained referring to FIG. 24 showing a plan view of the branching part of the guard rail. This is an example when a swingable guard plate is driven via a public known railroad switch.

In the drawing, reference numeral 280 is a guard plate swingable about a pivot 281. Catch members 282 and 283 are provided to receive the extremity of the swingable guard plate 280. Reference numeral 284 is a public known railroad switch. The guard plate 280 can be swung by the switch 284 having a rack-pinion mechanism 285. The guard plate 280 can be locked in a state its extremity is received by the catch member 282 or 283 by means of a locking mechanism (not shown) provided to the rack-pinion mechanism 285 of the switch 284.

As the switching device is composed to swing the guard plate 280 by adopting the public known railroad switch 284, the device can be provided at low cost.

Figure 25:
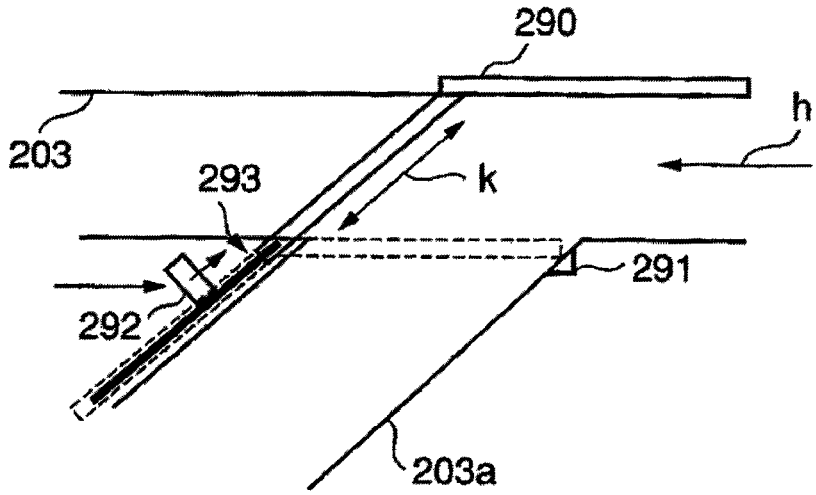
FIG. 25 is a plan view of another example of structure of the branching part of the guard rail provided with a slidable guard plate.

Yet another example of structure of the branching part of the guard rail will be explained referring to FIG. 25 showing a plan view of the branching part of the guard rail. In the drawing, reference numeral 290 is a guard plate consisting of a plate part parallel to the branched guard rail 203*a* and a plate part parallel to the guard rail 203. The guard plate 290 is installed to be slidable by means of a switch 292 having a sliding mechanism 293 in the directions k. Reference numeral 291 is a catch member for receiving the extremity of the guard plate 209 when the guard plate 209 is positioned to shut the groove of the guard rail 203*a*. The switch 292 and sliding mechanism are of public known construction.

With the switching device of this construction, selection of course can be performed only by sliding the guard plate 290 by means of the public known switch 292, so switching can be performed more easily as compared with the case of swinging a guard plate, and the device can be provided at low cost.

Figure 26:
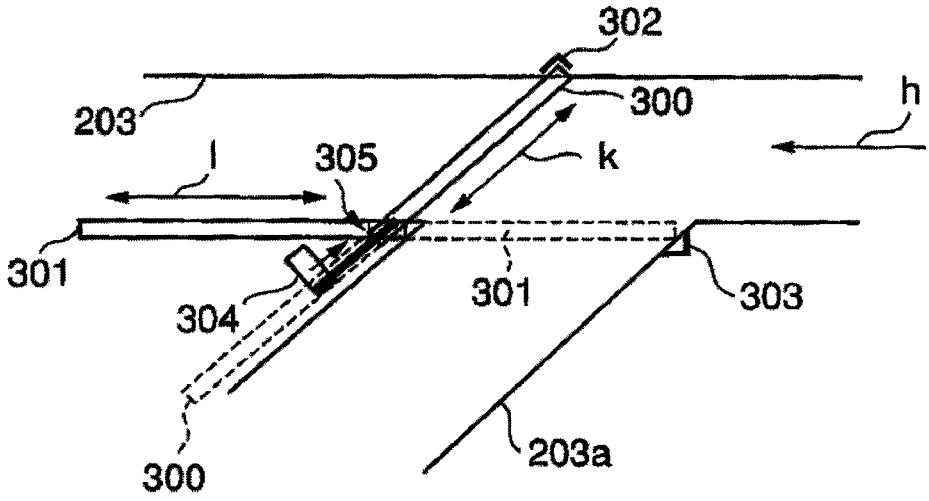
FIG. 26 is a plan view of another example of structure of the branching part of the guard rail provided with two slidable guard plates

Another example of structure of the branching part of the guard rail will be explained referring to FIG. 26 showing a plan view of the branching part of the guard rail. In the drawing, two guard plates 300 and 301 are provided at a Y-shaped bifurcation to be slidable in directions k and I respectively.

The guard plates 300 and 301 are slid by means of a switch 304 via a slide mechanism 305. As a mechanism of sliding the guard plates, a differential gear is adopted for example. Reference numerals 302 and 303 are catch members for receiving the extremity of the guard plate 300 when the guard plate 300 shuts the groove of the guard rail 203 and when the guard plate 301 shuts the groove of branched guard rail 203*a* respectively.

According to the switching device of this construction, the guard rails 301 and 302 ate provided to cross each other and driven by means of one switch 304, so the device can be provided at low cost. As the guard plates driven to slide, the device can be composed more simply as compared with a case the guard plate is swung.

Figure 27:
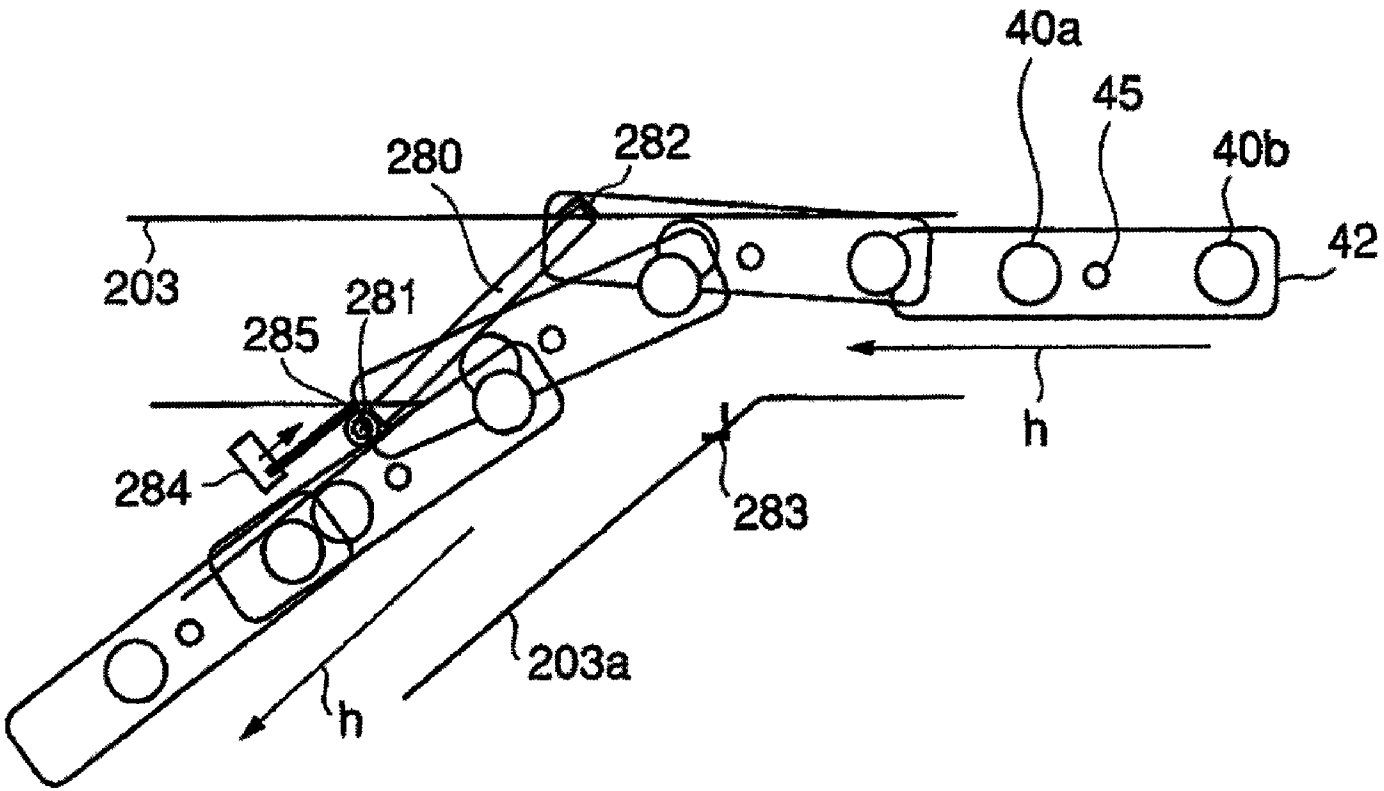
FIG. 27 is a plan view showing the change of attitude of supporting arm supporting guard wheels when the vehicle passes the branching part of the guard rail.
Figure 28:
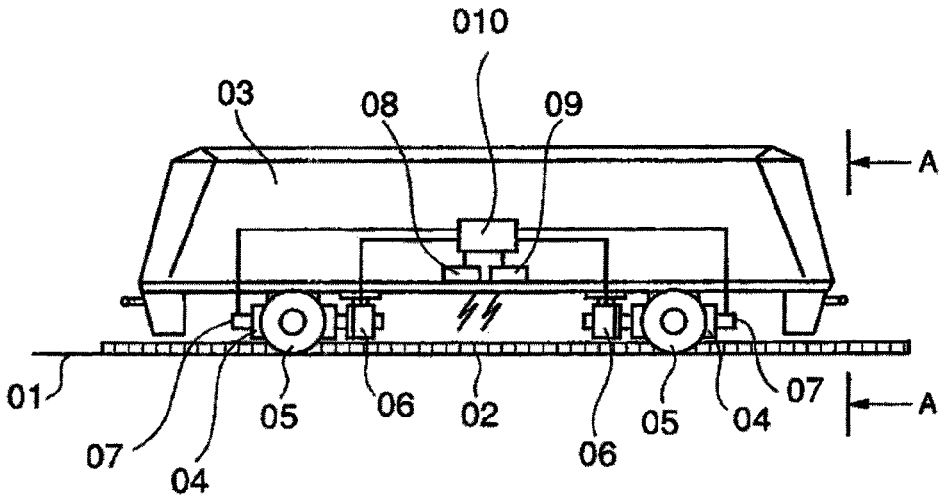
FIG. 28*a* is a schematic side elevation of a vehicle provided with the conventional steering system.
FIG. 28*b* is a schematic front elevation thereof.
Figure 28:
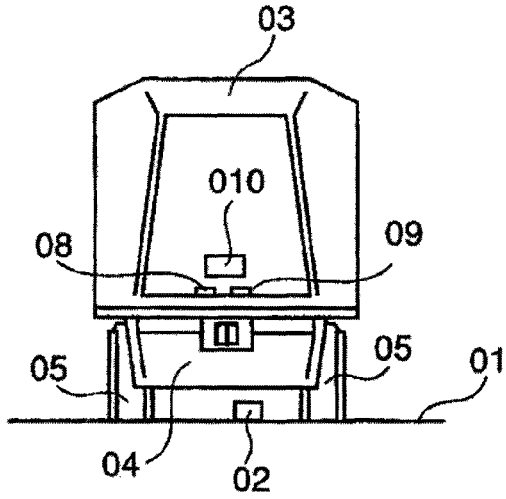
Figure 29:
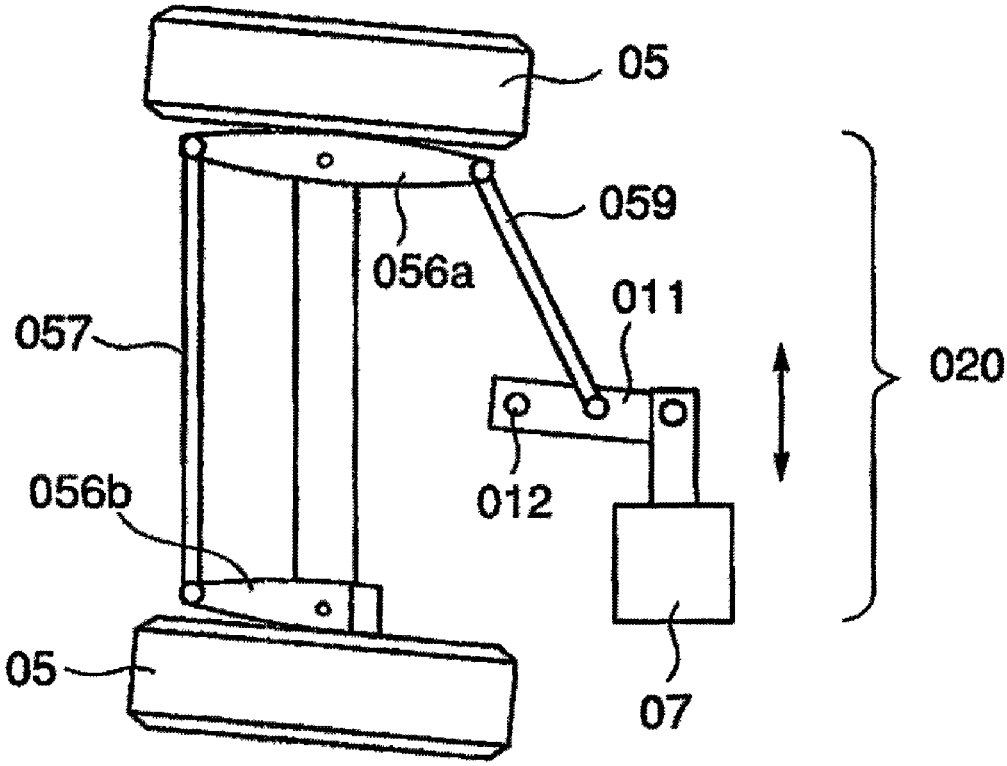
FIG. 29 is a schematic plan view of the conventional steering system.

FIG. 27 is a plan view showing the change of attitude of supporting arm 42 supporting guard wheels 40*a* and 40*b* when the vehicle 12 passes the branching part of the guard rail.

The supporting arm 42 is supported by the bogie of the vehicle rotatably about the support shaft 45, and the guard wheels 40*a* and 40*b* are supported under the supporting arm 42 at places sandwiching the support shaft 45.

In FIG. 27, when the vehicle 12 travels along the guard rail 203 and then along the branched guard rail 303*a* as shown by arrows h, the vehicle 12 travels with the guard wheels 40*a* and 40*b* not contacting one of the side walls of the groove of the guard rail 203, the guard plate 280 which is brought into a state to shut the groove of the guard rail 203 at the Y-shaped bifurcation, and one of the side walls of the branched guard rail 203*a* when the automatic steering mechanism 26 detailed in the description of the first embodiment operates normally. When malfunction occurs in the automatic steering mechanism 26, the vehicle 12 travels with the guard wheels 40*a* and 40*b* contacting the side wall of the groove of the guard rail 203, the guard plate 280, and the side wall of the groove of the branched guard rail 203*a*, as shown in FIG. 27.

In this way, the vehicle 12 advancing along the guard rail 203 is guided to advance along the branched guard rail 203*a* safely without the guard wheels derailed.

METHOD OF INDUSTRIAL APPLICATION OF INVENTION

According to the invention, at bifurcation or crossover sites of the guideway, smooth traveling of the vehicle provided with automatic steering mechanisms and a fail-safe mechanism consisting of a guard rail and guard wheels in the guided vehicle transportation system is made possible, eliminating problems that the tire of traveling wheel may be bitten into the opening of the groove of the guard rail at a part where the guard rail crosses the roadbed at bifurcation or crossover sites of the guideway.

The invention claimed is:

1. Structure of a bifurcation site and crossover site of a guideway in a guided vehicle transportation system in which a vehicle configured to travel on the guideway, the structure of the bifurcation site and crossover site of the guideway comprising:

left and right roadbeds which are adapted to support left and right traveling wheels of the vehicle, a depression formed between the roadbeds, and a guard rail made of a channel-steel having a U-shaped groove laid down on a surface of the depression along a center line between the roadbeds so that a top of the guard rail is level with surfaces of the roadbeds;

wherein the vehicle includes automatic steering systems for steering front wheels and rear wheels respectively by means of actuators each being provided for steering the front and rear wheels;

guard wheels in an underside of the vehicle rotatably in a lateral plane and received in the groove of the guard rail with ample clearances between the periphery of the guard wheel and the side walls of the groove of the guard rail being laid down along the center line of the guideway;

a fail-safe mechanism constituted by the guard wheels and the guard rail;

wherein a movable guard plate and driving means thereof are provided to switch a connection of the groove of the guard rail at a branching part thereof, and a groove width Wmin of each of the branching guard rails at a part thereof crossing one of the roadbeds is narrower than a groove width W in regions other than the crossing part and larger than a guard wheel diameter G.

2. Structure of a bifurcation site and crossover site of a guideway according to claim 1, wherein the groove width Wmin of the guard rails at a bifurcation part and crossover part thereof is narrower than the groove width W in regions other than the bifurcation part and crossover part of the guard rail and larger than the guard wheel diameter G.

3. Structure of a bifurcation site and crossover site of a guideway according to claim 2, wherein the groove width Wmin of each of the branching guard rails at a part thereof crossing a roadbed is narrower than the groove width W in regions other than the crossing part and larger than the guard wheel diameter G such that $W>Wmin>G+2c$, where $\approx 1$ mm.

4. Structure of a bifurcation site and crossover site of a guideway according to claim 1, wherein said movable guard plate is a guard plate laterally swingable about a pivot at an end thereof, whereby the connection of the groove of the guard rail at the crossover site is switchable by swinging the guard plate by the drive means.

5. Structure of a bifurcation site and crossover site of a guideway according to claim 1, wherein said movable guard plate is a right triangular prism-shaped guard member laterally slidable, whereby the connection of the groove of the guard rail at the crossover site is switchable by sliding the guard plate by the driving means.

6. Structure of a bifurcation site and crossover site of a guideway according to claim 1, wherein the guard rail further comprises flange parts formed at the top of each of the side walls of the groove to extend laterally toward the groove.

7. Structure of a bifurcation site and crossover site of a guideway in a guided vehicle transportation system in which a vehicle configured to travel on the guideway;

the structure of the bifurcation site and crossover site of the guideway comprising:

left and right roadbeds on which left and right traveling wheels of the vehicle, a depression formed between the roadbeds, and a guard rail made of a channel-steel having a U-shaped groove laid down on a surface of the depression along a center line between the roadbeds so that a top of the guard rail is level with surfaces of the roadbeds;

wherein the vehicle includes automatic steering systems for steering front wheels and rear wheels respectively by means of actuators each being provided for steering the front and rear wheels;

guard wheels in an underside of the vehicle rotatably in a lateral plane and received in the groove of the guard rail with ample clearances between the periphery of the guard wheel and the side walls of the groove of the guard rail being laid down along the center line of the guideway;

a fail-safe mechanism constituted by the guard wheels and the guard rail;

wherein a movable guard plate and driving means thereof are provided to switch a connection of the groove of the guard rail at a bifurcation thereof, and a movable plate and driving means thereof are pluggable or coverable each of openings of grooves of guard rails in a region where the guard rail crosses a roadbed so that the movable plate is moved to plug or cover the groove thereby preparing a flat surface level with the roadbeds.

8. Structure of a bifurcation site and crossover site of a guideway according to claim 7, wherein said movable plate is a plate provided in the groove of the guard rail so that the plate is moveable up until an upper surface thereof is level with the top of the guard rail thereby plugging the opening of the groove of the guard rail and moved down to open the opening of the groove of the guard rail and further to secure a space for the guard wheels received in the groove to proceed without interfering with the plate by means of the drive means.

9. Structure of a bifurcation site and crossover site of a guideway according to claim 7, wherein said movable plate is a plate laterally slidable provided on the roadbed so that the upper surface thereof is level with the surface of the roadbed so that the plate is slidable by the drive means to cover the guard rail.

10. Structure of a bifurcation site and crossover site of a guideway according to claim 7, wherein said movable guard plate and said movable plate are controlled in association with each other by a controller located in a ground station in accordance with position of the traveling vehicle on the guideway.

11. Structure of a bifurcation site and crossover site of a guideway according to claim 7, wherein said movable guard plate is a guard plate laterally swingable about a pivot at an end thereof, whereby the connection of the groove of the guard rail at the crossover site is switchable by swinging the guard plate by the drive means.

12. Structure of a bifurcation site and crossover site of a guideway according to claim 7, wherein said movable guard plate is a right triangular prism-shaped guard member laterally slidable, whereby the connection of the groove of the guard rail at the crossover site is switchable by sliding the guard plate by the driving means.

13. Structure of a bifurcation site and crossover site of a guideway according to claim 7, wherein the guard rail further comprises flange parts formed at the top of each of the side walls of the groove to extend laterally toward the groove.

* * * * *